US010208360B2

(12) United States Patent
Tetsui

(10) Patent No.: US 10,208,360 B2
(45) Date of Patent: Feb. 19, 2019

(54) HOT-FORGED TIAL-BASED ALLOY AND METHOD FOR PRODUCING THE SAME

(71) Applicant: NATIONAL INSTITUTE FOR MATERIALS SCIENCE, Ibaraki (JP)

(72) Inventor: Toshimitsu Tetsui, Ibaraki (JP)

(73) Assignee: NATIONAL INSTITUTE FOR MATERIALS SCIENCE, Ibaraki (JP)

( * ) Notice: Subject to any disclaimer, the term of this patent is extended or adjusted under 35 U.S.C. 154(b) by 469 days.

(21) Appl. No.: 14/898,257

(22) PCT Filed: Jun. 2, 2014

(86) PCT No.: PCT/JP2014/064611

§ 371 (c)(1),
(2) Date: Dec. 14, 2015

(87) PCT Pub. No.: WO2014/203714

PCT Pub. Date: Dec. 24, 2014

(65) Prior Publication Data

US 2016/0145703 A1 May 26, 2016

(30) Foreign Application Priority Data

Jun. 19, 2013 (JP) ..... 2013-128866
Feb. 19, 2014 (JP) ..... 2014-029044

(51) Int. Cl.
*C22C 14/00* (2006.01)
*C21D 9/00* (2006.01)
(Continued)

(52) U.S. Cl.
CPC ..... *C21D 9/0068* (2013.01); *C21D 8/00* (2013.01); *C22C 14/00* (2013.01); *C22C 30/00* (2013.01);
(Continued)

(58) Field of Classification Search
CPC ..... C22C 14/00; C22F 1/183
See application file for complete search history.

(56) References Cited

U.S. PATENT DOCUMENTS 5,518,690 A * 5/1996 Masahashi ..... C22C 1/00 420/418
6,051,084 A 4/2000 Tetsui
2001/0022946 A1 9/2001 Tetsui et al.

FOREIGN PATENT DOCUMENTS

JP 6-49565 2/1994
JP 6-340955 12/1994
(Continued)

OTHER PUBLICATIONS

Office Action dated Jun. 6, 2017 in Japanese Application No. 2013-128866, with English translation.
(Continued)

*Primary Examiner* — Jessee R Roe
(74) *Attorney, Agent, or Firm* — Wenderoth, Lind & Ponack, L.L.P.

(57) ABSTRACT

Provided is a hot-forged TiAl-based alloy of the present invention containing 40 to 45 atom % of Al and additive elements in the following composition ratio (A) or (B), and the balance Ti with inevitable impurities: (A) Nb: 7 to 9 atom %, Cr: 0.4 to 4.0 atom %, Si: 0.3 to 1.0 atom %, and C: 0.3 to 1.0 atom %; and (B) at least one of Cr: 0.1 to 2.0 atom %, Mo: 0.1 to 2.0 atom %, Mn: 0.1 to 4.0 atom %, Nb: 0.1 to 8.0 atom %, and V: 0.1 to 8.0 atom %. The TiAl-based alloy is characterized by having a fine structure of densely arranged lamella grains that are laminated alternately with a $Ti_3Al$ phase ($\alpha 2$-phase) and a TiAl phase ($\gamma$-phase) and have an average grain size of 1 to 200 μm.

3 Claims, 25 Drawing Sheets

(51) Int. Cl.

| | |
|---|---|
| ***C22C 30/00*** | (2006.01) |
| ***C22F 1/18*** | (2006.01) |
| ***C22F 1/04*** | (2006.01) |
| ***C21D 8/00*** | (2006.01) |
| ***F01D 5/28*** | (2006.01) |
| *C22F 1/00* | (2006.01) |

(52) U.S. Cl.

CPC ..... *C22F 1/04* (2013.01); *C22F 1/18* (2013.01); *C22F 1/183* (2013.01); *F01D 5/28* (2013.01); *C22F 1/00* (2013.01); *F05D 2220/30* (2013.01); *F05D 2230/25* (2013.01); *F05D 2230/40* (2013.01); *F05D 2240/30* (2013.01); *F05D 2300/174* (2013.01)

(56) References Cited

FOREIGN PATENT DOCUMENTS

| | | |
|---|---|---|
| JP | 7-173557 | 7/1995 |
| JP | 2000-199025 | 7/2000 |
| JP | 4209092 | 10/2008 |
| JP | 4287991 | 4/2009 |
| JP | 2009-215631 | 9/2009 |

OTHER PUBLICATIONS

Office Action dated Dec. 26, 2017 in Japanese Application No. 2014-029044, with English translation.

Office Action dated Jul. 31, 2018 in Japanese Application No. 2014-029044, with English translation.

Extended European Search Report dated Feb. 13, 2017 in European Patent Application No. 14814461.1.

EPO provided English Machine translation of JP 6-340955 (Dec. 1994), which was previously cited in the Information Disclosure Statement submitted Dec. 14, 2015.

International Search Report dated Jul. 8, 2014 in corresponding International (PCT) Application No. PCT/JP2014/064611.

* cited by examiner

Fig. 1
(A)
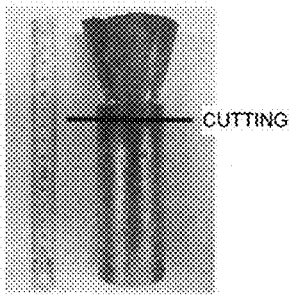
(B)
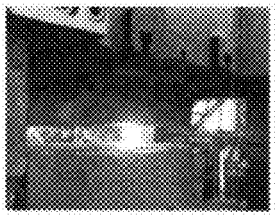
(C)
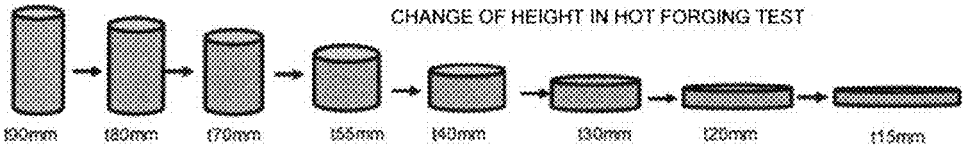

Fig. 2

| Alloy | Classification | Composition (at%) | | | | | | Area ratio of β-phase for material that is water-cooled at 1350℃ for one hour (%) | Forging test result at 1350℃ | Presence or absence of β-phase in heat treatment 1350℃ × 1h→ 0.2℃/min | Creep rupture time of appropriately heat-treated material in state of 870℃ × 225 MPa (h) |
|---|---|---|---|---|---|---|---|---|---|---|---|
| | | Al | Nb | Cr | Si | C | (41-Al)/3+0.25Nb+0.8Cr-0.8Si-1.7C | | | | |
| Alloy 1 | Comparative Alloy | 40 | 8 | | 1.1 | 0.6 | 0.43 | 10 | Crack occurrence | – | – |
| Alloy 2 | Comparative Alloy | 40 | 9 | 3.2 | 0.8 | 0.5 | 3.65 | 100 | Good | Presence | – |
| Alloy 3 | Comparative Alloy | 40 | 8 | | 0.4 | 1.1 | 0.14 | 0 | Crack occurrence | – | – |
| Alloy 4 | Comparative Alloy | 40 | 7 | 3 | 0.6 | 0.9 | 2.47 | 63 | Good | Presence | 16 |
| Alloy 5 | Comparative Alloy | 41 | 7 | 0.5 | 0.8 | 0.2 | 1.17 | 33 | Good | 26 | 27 |
| Alloy 6 | Comparative Alloy | 41 | 7 | | 0.9 | 0.4 | 0.35 | 12 | Crack occurrence | – | – |
| Alloy 7 | Comparative Alloy | 41 | 8 | 1.1 | 0.8 | 0.8 | 0.88 | 23 | Crack occurrence | – | – |
| Alloy 8 | Comparative Alloy | 41 | 9 | 2.5 | 0.7 | 0.4 | 3.01 | 74 | Good | Presence | – |
| Alloy 9 | Inventive Alloy | 41 | 7 | 1.5 | 0.5 | 0.4 | 1.87 | 52 | Good | Absence | 45 |
| Alloy 10 | Comparative Alloy | 42 | 8 | 0.3 | 0.4 | 0.4 | 0.91 | 27 | Crack occurrence | – | – |
| Alloy 11 | Comparative Alloy | 42 | 8 | 3 | 0.9 | 0.4 | 2.67 | 67 | Good | Presence | – |
| Alloy 12 | Comparative Alloy | 42 | 9 | 0.6 | 0.9 | 0.7 | 0.49 | 13 | Crack occurrence | – | – |
| Alloy 13 | Inventive Alloy | 42 | 8 | 2.3 | 0.9 | 0.7 | 1.60 | 42 | Good | Absence | 75 |
| Alloy 14 | Inventive Alloy | 42 | 8 | 1.5 | 0.5 | 0.4 | 1.79 | 49 | Good | Absence | 54 |
| Alloy 15 | Comparative Alloy | 42 | 8 | 4.3 | 1 | 0.8 | 2.95 | 80 | Good | Presence | 10 |
| Alloy 16 | Comparative Alloy | 43 | 8 | | 0.5 | 0.5 | 0.08 | 0 | Crack occurrence | – | – |
| Alloy 17 | Comparative Alloy | 43 | 7 | 4.5 | 0.7 | 0.8 | 2.76 | 68 | Good | Presence | – |
| Alloy 18 | Inventive Alloy | 43 | 8 | 1.5 | 0.4 | 0.4 | 1.53 | 36 | Good | Absence | 43 |
| Alloy 19 | Comparative Alloy | 43 | 9 | 3.8 | 0.5 | 0.4 | 3.54 | 95 | Good | Presence | – |
| Alloy 20 | Comparative Alloy | 43 | 8 | 1 | 0.7 | 0.5 | 0.72 | 20 | Crack occurrence | – | – |
| | | | | | | | | Procedure 2 | Procedure 3 | Procedure 4 | Procedure 6 |

Fig. 3

| Alloy | Classification | Composition (at%) | | | | | | Area ratio of β-phase for material that is water-cooled at 1350°C for one hour (%) | Forging test result at 1350°C | Presence or absence of β-phase in heat treatment 1350°C × 1h→ 0.2°C/min | Creep rupture time of appropriately heat-treated material in state of 870°C × 225 MPa (h) |
|---|---|---|---|---|---|---|---|---|---|---|---|
| | | Al | Nb | Cr | Si | C | (41-Al)/3+0.25Nb+0.8Cr-0.8Si-1.7C | | | | |
| Alloy 21 | Comparative Alloy | 43 | 7 | 2 | 0.2 | 0.6 | 1.50 | 42 | Good | Absence | 23 |
| Alloy 22 | Inventive Alloy | 44 | 9 | 3 | 0.8 | 0.6 | 1.99 | 55 | Good | Absence | 69 |
| Alloy 23 | Comparative Alloy | 44 | 8 | 0.3 | 0.3 | 0.3 | 0.49 | 16 | Crack occurrence | – | – |
| Alloy 24 | Comparative Alloy | 44 | 9 | 4 | 0.7 | 0.6 | 2.87 | 73 | Good | Presence | 13 |
| Alloy 25 | Comparative Alloy | 44 | 7 | 1.6 | 0.8 | 0.8 | 0.03 | 0 | Crack occurrence | – | – |
| Alloy 26 | Inventive Alloy | 44 | 8 | 3.5 | 1 | 0.6 | 1.98 | 47 | Good | Absence | 75 |
| Alloy 27 | Inventive Alloy | 45 | 9 | 2 | 0.4 | 0.4 | 1.52 | 37 | Good | Absence | 46 |
| Alloy 28 | Comparative Alloy | 45 | 9 | 2 | 0.4 | 1.1 | 0.33 | 10 | Crack occurrence | – | – |
| Alloy 29 | Comparative Alloy | 45 | 8 | 4.2 | 0.7 | 0.5 | 2.62 | 65 | Good | Presence | – |
| Alloy 30 | Comparative Alloy | 45 | 8 | 2 | 1.1 | 0.5 | 0.54 | 15 | Crack occurrence | – | – |
| Alloy 31 | Inventive Alloy | 45 | 9 | 3 | 0.9 | 0.9 | 1.07 | 33 | Good | Absence | 80 |
| Alloy 32 | Comparative Alloy | 46 | 7 | 4.3 | 0.4 | 0.3 | 2.69 | 71 | Good | Presence | – |
| Alloy 33 | Comparative Alloy | 46 | 8 | 2.3 | 0.7 | 0.7 | 0.42 | 14 | Crack occurrence | – | – |
| Alloy 34 | Comparative Alloy | 46 | 9 | 5 | 0.5 | 0.6 | 3.16 | 84 | Good | Presence | – |
| Alloy 35 | Comparative Alloy | 46 | 9 | 3.3 | 0.5 | 1.1 | 0.95 | 26 | Crack occurrence | – | – |
| Alloy 36 | Comparative Alloy | 46 | 8 | 3 | 0.9 | 0.9 | 0.48 | 11 | Crack occurrence | – | – |
| | | | | | | | | Procedure 2 | Procedure 3 | Procedure 4 | Procedure 6 |

Fig. 20
(A)
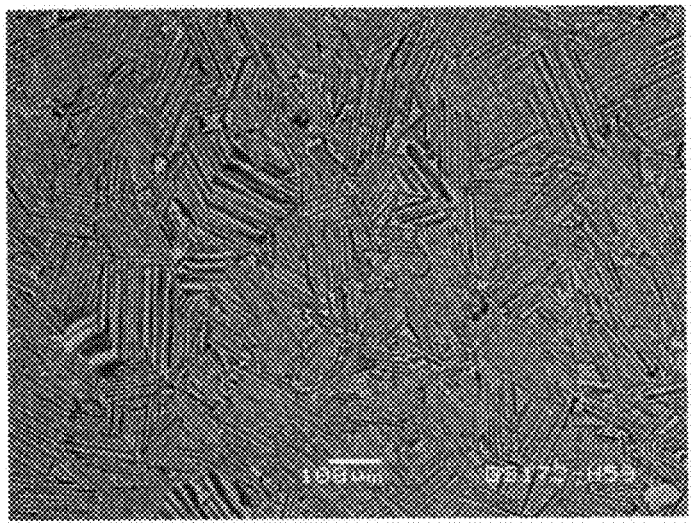
(B)
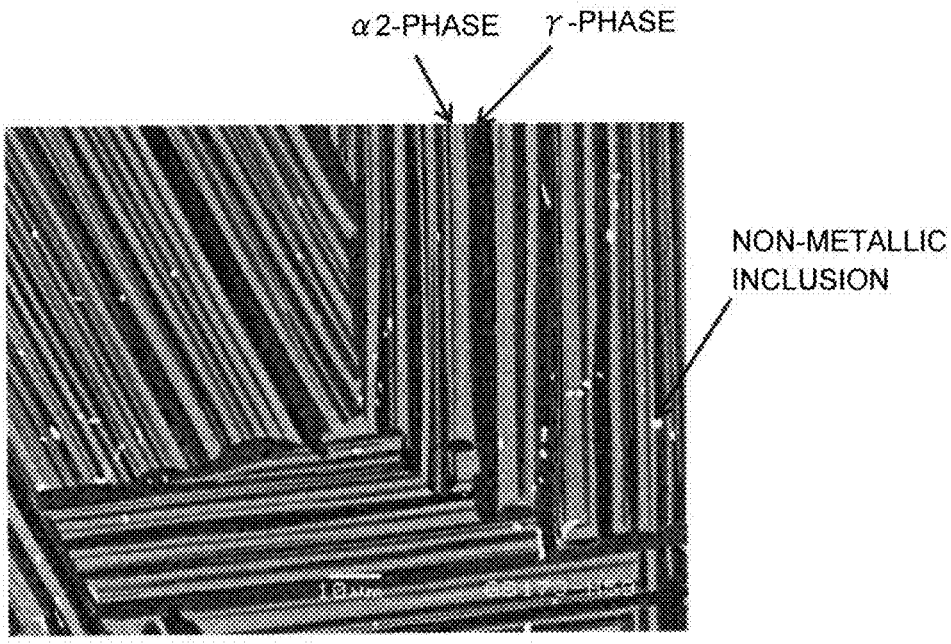

Fig. 21
(A)
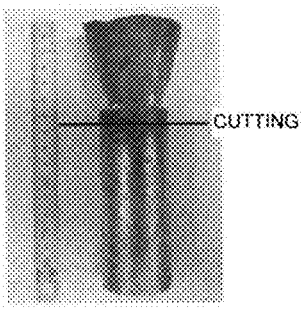
(B)
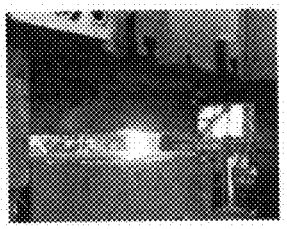
(C)
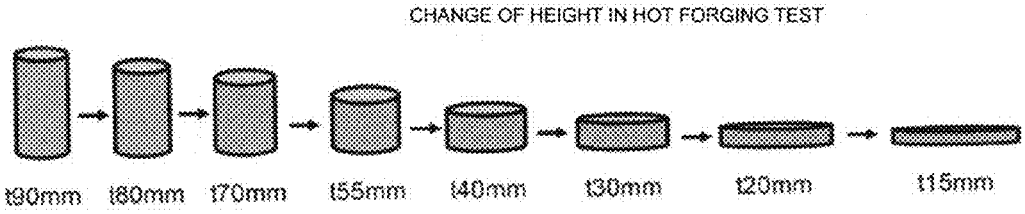

Fig. 23
(A)
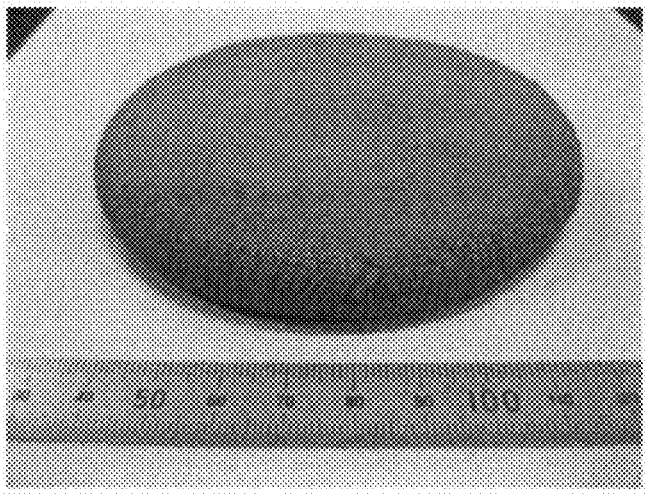
EXAMPLE OF NON-CRACK
(B)
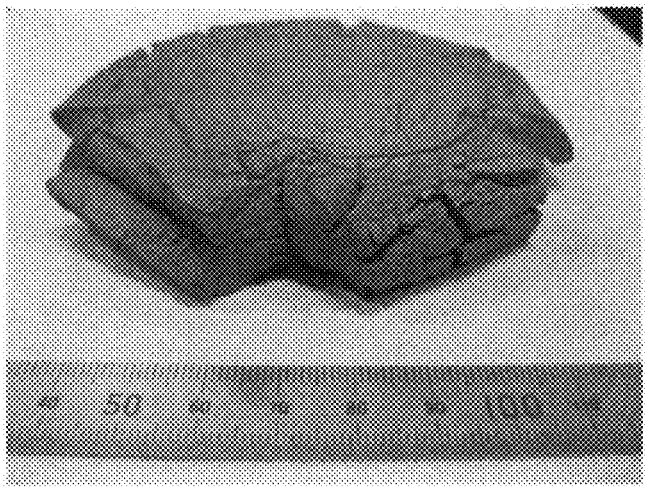
EXAMPLE OF
CRACK OCCURRENCE Fig. 25
(A)
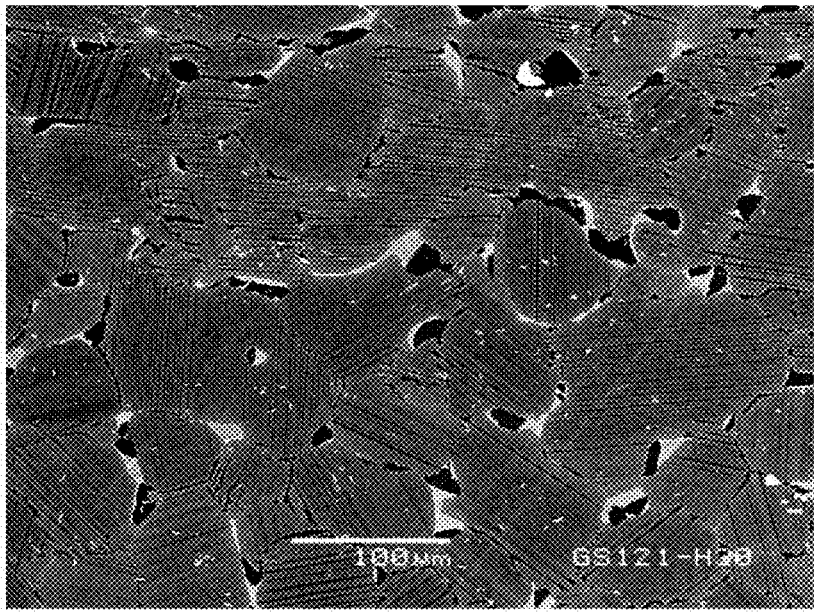
(B)
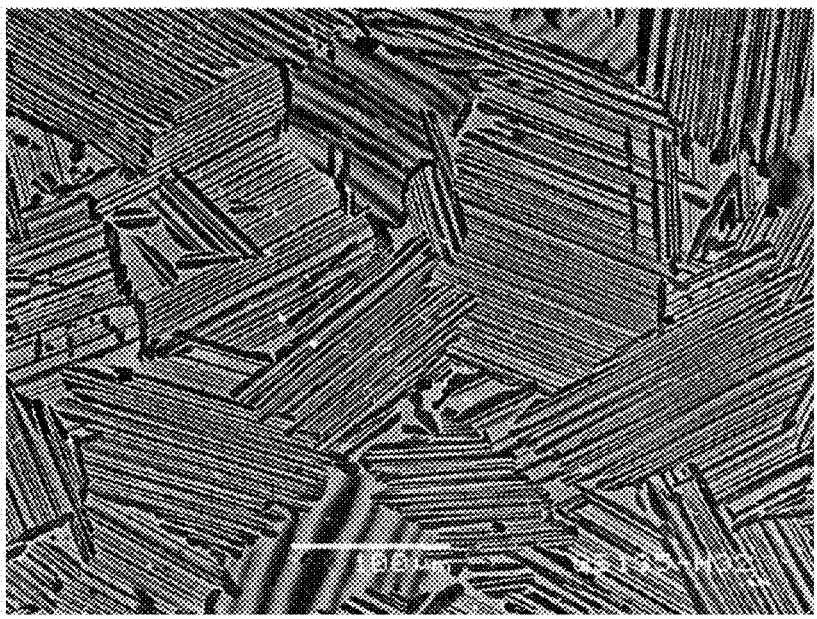

HOT-FORGED TIAL-BASED ALLOY AND METHOD FOR PRODUCING THE SAME

TECHNICAL FIELD

The present invention relates to a TiAl-based alloy to be suitably used for a rotor blade of a gas turbine for power generation, a gas turbine for aircraft, or the like, and specifically, to a hot-forged TiAl-based alloy in which hot forgeability is excellent, strength is high at a high temperature, and ductility is also excellent in a room temperature. In addition, the present invention relates to a method for producing the hot-forged TiAl-based alloy.

BACKGROUND ART

Recently, as materials used for a rotor blade of various turbines, TiAl-based alloys, being lightweight and having excellent heat resistance, have attracted attention. Particularly, in the case of a large rotatable rotor blade, as the constituent member of the rotor blade become lighter, the centrifugal stress becomes smaller, which enables improvement in the maximum engine speed, an increase in area of the rotor blade, and a reduction in the load stress applied to a disk portion of the rotor blade and is very beneficial to the increase in efficiency of the entire apparatus.

This TiAl-based alloy is an alloy composed mainly of TiAl or $Ti_3Al$, which is an intermetallic compound having excellent high-temperature strength, and the alloy is excellent in heat resistance as described above. The TiAl alloy, which is a lightweight heat resistance alloy, is used as a casting material and a forged material.

The casting material has a perfect lamellar structure laminated with a $\alpha 2$-phase and a $\gamma$-phase which are excellent in high-temperature strength, but there is a problem that room-temperature ductility is deficient because forgeability is poor and a crystal grain is coarsened. Therefore, for example, a technique is proposed in Patent Literatures 1 and 2, in which a TiAl-based alloy material as a hot forging material having a predetermined composition is held in an equilibrium temperature range of $(\alpha+\beta)$-phase and is then subjected to plastic working, thereby eliminating casting defects and fining a structure by a synergistic effect of working distortion and phase transformation. Moreover, thereafter, the hot-forged TiAl-based alloy material is held in an equilibrium temperature range of $(\alpha+\beta)$-phase, $(\alpha+\beta+\gamma)$-phase, or $(\beta+\gamma)$-phase, an area fraction of lamella grain and $\beta$-phase or a grain size of the lamella grain is controlled, and thus the TiAl-based alloy having excellent machinability and high-temperature strength can be produced. As a hot working method other than the hot forging, for example, extrusion or rolling-type forging can be used.

CITATION LIST

Patent Literature

Patent Literature 1: JP 4209092 B1
Patent Literature 2: JP 4287991 B1
Patent Literature 3: JP 6-49565 A

SUMMARY OF INVENTION

Technical Problem

However, the case of the casting material described above was not sufficient in view of a general coarseness of the cast structure and improvement in ductility at a room temperature. In particular, with respect to a rotor blade used for an engine for industrial use or the like, foreign matter such as sludge may collide with the rotor blade at the time of operation, or at the time of production of the rotor blade, the blade may be broken due to impact at the time of fixing the blade to an outer periphery of the disk with a hammer. Hence, it becomes necessary to improve ductility or impact properties of the TiAl based alloy. In the casting material of the above conventional technique, however, it was difficult to improve the ductility or the impact properties.

In the case of the casting material, production of small parts such as vehicle parts is relatively easy. However production of large parts has been difficult because castability such as molten-metal flowability of the TiAl-based alloy was generally poor.

On the other hand, isothermal forging is also commonly used as a forging method of the forged material of the TiAl-based alloy, the isothermal forging being characterized in that the mold and the material are held together at a high temperature and are slowly deformed at a constant temperature. With the isothermal forging, however, there are problems in that process costs are very expensive and production of large parts can be difficult because of the limitation of methodology that the mold and the material are heated together.

Meanwhile, with respect to hot forging material in the forged material of the TiAl-based alloy, for example, as disclosed in Patent Literature 3, a $\beta$-phase having excellent high temperature deformability (that is, small high-temperature strength) is generated by the addition of a $\beta$-stabilization element (Mn, V, Nb, Cr, or the like), and thus so-called hot forging can be performed to cause high-speed deformation as a temperature decreases during the forging. In the hot forged material of the conventional TiAl-based alloy, however, since the $\beta$-phase remains in the final product, there were problems in that high-temperature strength was small in a usable state and an available temperature was about 700° C. in maximum which was significantly lower than about 850° C. which was an available temperature of the casting material.

The present invention has been made to solve the above problems in the TiAl-based alloy and an object thereof is to provide a TiAl-based alloy which is excellent in hot forgeability as a hot forging material, ductility at a room temperature, and impact properties as well as having excellent high-temperature strength.

Solution to Problem

A TiAl-based alloy of the present invention, which solves the above problems, contains: Al: 40 to 45 atom %, and additive elements in the following composition ratio (A) or (B), and the balance Ti with inevitable impurities, (A) Nb: 7 to 9 atom %,
Cr: 0.4 to 4.0 atom %,
Si: 0.3 to 1.0 atom %, and
C: 0.3 to 1.0 atom %;

(B) at least one of Cr: 0.1 to 2.0 atom %,
Mo: 0.1 to 2.0 atom %,
Mn: 0.1 to 4.0 atom %,
Nb: 0.1 to 8.0 atom %, and
V: 0.1 to 8.0 atom %, in which the TiAl-based alloy has a fine structure of densely arranged lamella grains that are laminated alternately with a $Ti_3Al$ phase ($\alpha 2$-phase) and a TiAl phase ($\gamma$-phase) and have an average grain size of 1 to 200 μm.

A method for producing the TiAl-based alloy according to the present Invention includes:

a process in which the TiAl-based alloy is held at a coexisting temperature range of a hexagonal close-packed structure phase (α-phase) and a body-centered cubic structure phase (β-phase) and is then subjected to hot forging; and a process in which the hot-forged TiAl-based alloy material is held in a temperature range of from 1180° C. to 1290° C. for 0.5 to 20 hours and is subjected to a heat treatment at a cooling rate of from 0.3 [° C./min.] to 10 [° C./min.] at the same time.

Advantageous Effects of Invention

According to the present invention, a TiAl-based alloy is provided which is excellent in hot forgeability as a hot forging material, ductility at a room temperature, and impact properties as well as having excellent high-temperature strength.

BRIEF DESCRIPTION OF DRAWINGS

FIGS. 1(A) and 1(B) are appearance photographs illustrating a TiAl alloy ingot used in a first embodiment of the present invention and FIG. 1(C) is an explanatory view of a hot forging test procedure performed for evaluating hot forgeability.

FIG. 2 is a diagram illustrating a summary of compositions of trial ingots and evaluation test results of the ingots.

FIG. 3 is a diagram illustrating a summary of compositions of trial ingots and evaluation test results of the ingots.

FIGS. 20(A) and 20(B) are reflected electron image photographs of a test material obtained in such a manner that the hot-forged TiAl material according to the second embodiment of the present invention which is held at 1200° C. of a α-region for two hours and is then cooled at 3° C./min.

FIGS. 21(A) to 21(C) are diagrams illustrating a hot forging test for evaluating hot forgeability of a TiAl alloy including the hot-forged TiAl material according to the second embodiment of the present invention

FIGS. 23(A) and 23(B) are examples of appearance photographs for a test material after the alloy having the evaluation result of the hot forgeability illustrated in FIG. 22 is subjected to a hot forging test.

FIGS. 25(A) and 25(B) are examples of reflected electron image photographs of the alloy having the evaluation result of the presence or absence of the β-phase residue after the heat treatment illustrated in FIG. 24, after the heat treatment.

DESCRIPTION OF EMBODIMENTS

Figure 4:
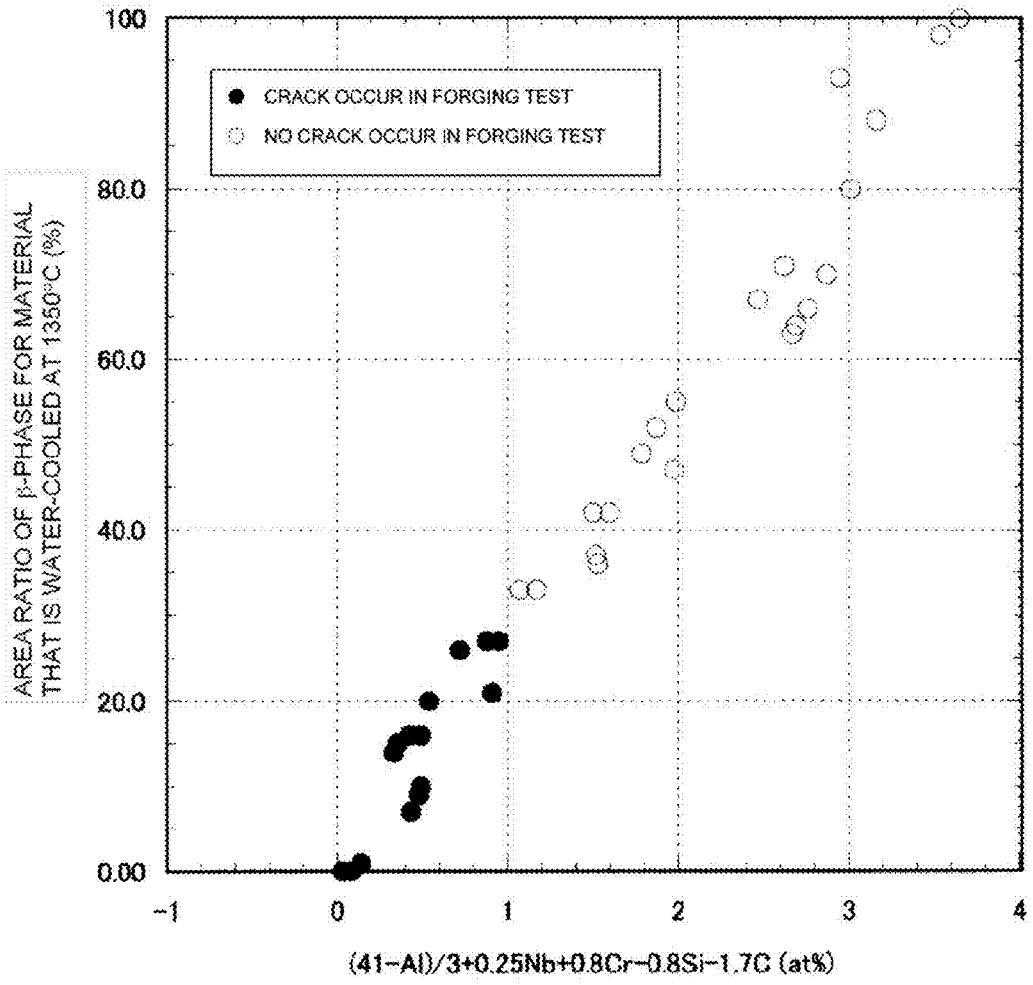
FIG. 4 is an explanatory view illustrating a relation among an alloy element parameter P of a trial ingot, an area ratio of a β-phase existing in a material, which is water-cooled in a condition of 1350° C.×1 h (procedure 2 to be described below), and a forging test result at 1350° C. (procedure 3).

A TiAl-based alloy according to a first embodiment of the invention consists of: 41 to 45 atom % of Al, 7 to 9 atom % of Nb, 0.4 to 4.0 atom % of Cr, 0.3 to 1.0 atom % of Si, and 0.3 to 1.0 atom % of C, and the balance Ti with inevitable impurities. In the TiAl-based alloy, an alloy element parameter P obtained by the following formula is in the composition range of from 1.1 to 2.3, and in a final state after a heat treatment subsequent to hot forging, the TiAl-based alloy has a fine structure in which lamella grains laminated alternately with a $Ti_3Al$ phase (α2-phase) and a TiAl phase (γ-phase) are densely arranged and a β-phase is not included, the lamella grains having an average grain size of 1 to 200 μm:

$$P=(41-Al)/3+0.25Nb+0.8Cr-0.8Si-1.7C$$

The other aspect of the TiAl-based alloy according to the first embodiment of the present invention is a TiAl-based alloy in which at least one element selected from the group consisting of W, Mo, B, Hf, Ta, and Zr is further contained in the above TiAl-based alloy to be 0.1 to 3 atom % in total. By the addition of a small amount of these elements, it is possible to increase high-temperature strength, creep strength, and oxidation resistance.

As a method for producing the TiAl-based alloy having the composition, first, an ingot is prepared by dissolution, a process in which the ingot is held at a coexisting temperature range of a hexagonal close-packed structure phase (α-phase) and a body-centered cubic structure phase (β-phase) and is then subjected to hot forging, and a process in which the hot-forged TiAl-based alloy material is held in a temperature range of from 1230° C. to 1290° C., which is an α-single phase region, for 1 to 20 hours and is subjected to a heat treatment at a cooling rate of from 1 [° C./min.] to 10 [° C./min.].

In the method for producing the TiAl-based alloy according to the first embodiment of the present invention, after the structure including the β-phase formed after the hot forging is turned into the α-single phase during the heat treatment in the heat treatment process, and transformation of α→α+γ→α2+γ occurs in the cooling process, that is, the hexagonal close-packed structure phase (α-phase) is transformed into an eutectoid phase of the hexagonal close-packed structure phase (α-phase) and the TiAl phase (γ-phase), and is further transformed into an eutectoid phase of the $Ti_3Al$ phase (α2-phase) and the TiAl phase (γ-phase).

A rotor blade for turbine of the present invention is characterized in that the TiAl-based alloy having the above composition is produced by the production method described above.

A gas turbine for power generation, a gas turbine for aircraft, a turbocharger for ship, or a gas turbine or a steam turbine for various industrial machines according to the invention is characterized by using the rotor blade for turbine.

Hereinafter, the reason why the composition and the content of the TiAl-based alloy according to the first embodiment of the present invention are limited as described above will described as follows. In the following description, a percentage (%) indicating the content is referred to as atom %.

Aluminum (Al): When the content of Al is in the range of from 41.0 atom % to 45.0 atom %, it is preferred because the β-phase does not exist in a final state after the heat treatment, a perfect lamellar structure laminated with the α2-phase and the γ-phase is obtained, and the hot forgeability is excellent. The excellence in the hot forgeability means that large cracks do not occur even when the hot forging is performed under conditions illustrated in FIGS. 1(A) and 1(C) in particular and fine cracks caused by the change in surface structure of oxidation or the like are not included. When the content of Al is less than 41.0 atom %, the hot forgeability is good, but the ratio of the α2-phase becomes too high. Thus, in this case, the ductility may be deteriorated. When the content of Al exceeds 45.0 atom %, the hot forgeability may become poor.

Niobium (Nb): When the content of Nb is in the range of from 7.0 atom % to 9.0 atom %, it is preferred because oxidation resistance is improved. When the content of Nb is less than 7.0 atom %, the effect of improving the oxidation resistance may be insufficient. The content of Nb exceeds 9.0 atom %, problems may arise in that the β-phase remains and the weight increases.

Chromium (Cr): When the content of Cr is in the range of from 0.4 atom % to 4.0 atom %, it is preferred because the hot forgeability is improved. When the content of Cr is less than 0.4 atom %, for example, as indicated in alloys 10 and 23 to be described below, the hot forgeability may be deteriorated. When the content of Cr exceeds 4.0 atom %, the β-phase remains, and the high-temperature strength such as creep strength may be deteriorated.

Silicon (Si): When the content of Si is in the range of from 0.3 atom % to 1.0 atom %, it is preferred because the creep strength is improved. When the content of Si is less than 0.3 atom %, for example, as indicated in an alloy 21 to be described below, the creep strength may not be improved. When the content of Si exceeds 1.0 atom %, the hot forgeability may become poor.

Carbon (C): When the content of C is in the range of from 0.3 atom % to 1.0 atom %, it is preferred because the creep strength is improved. When the content of C is less than 0.3 atom %, for example, as indicated in an alloy 5 to be described below, the creep strength may be insufficient. When the content of C exceeds 1.0 atom %, the hot forgeability may become poor.

In the TiAl-based alloy according to the first embodiment of the present invention, the alloy element parameter "P=(41−Al)/3+0.25Nb+0.8Cr−0.8Si−1.7C" is preferably in the range of 1.1 atom % to 2.3 atom %. When the alloy element parameter P is less than 1.1 atom %, the hot forgeability may become poor. When the alloy element parameter P exceeds 2.3 atom %, since the β-phase remains even after the heat treatment, the high-temperature strength such as creep strength is deteriorated and thus an available temperature may be lowered.

In the TiAl-based alloy according to the first embodiment of the present invention, the crystal grain size of the lamella grain is preferably 1 μm or more and 200 μm or less, and particularly preferably 30 μm or more and 100 μm or less. When the crystal grain size of the lamella grain is 100 μm or less, it is preferred because the room-temperature ductility is ensured. It is industrially very difficult to make the average grain size of the lamella grain to be less than 1 μm, and when the average grain size of the lamella grain is less than 30 μm, production costs may increase or production yield may be reduced. On the other hand, when average grain size exceeds 200 μm, the room-temperature ductility, especially, impact properties may be reduced.

In the method for producing the TiAl-based alloy according to the first embodiment of the present invention, the reason why the heat treatment conditions of the forging material are limited as described will be described below. The temperature range in which the hot-forged TiAl-based alloy is held in the equilibrium temperature range of the α-single phase region is preferably from 1230° C. to 1290° C. When the temperature range is lower than 1230° C., since it is within the (α+γ) region, the perfect lamellar structure may not be formed after cooling. When the temperature range exceeds 1290° C., since it is within the (α+β) region, the β-phase may remain by the cooling rate after the cooling.

In addition, the time at which the hot-forged TiAl-based alloy material is held within the equilibrium temperature range of the α-single phase region is preferably from one hour to 20 hours. When the holding time is shorter than one hour, the time is too short and thus the α-single phase may not be obtained. When the holding time exceeds 20 hours, the time is too long and thus the crystal grain size of the α-grain (final lamella grain) is coarsened, whereby the ductility or the like may be deteriorated.

Furthermore, the cooling rate after the hot-forged TiAl-based alloy material is held for a predetermined holding time within the equilibrium temperature range of the α-single phase region is preferably from 1 [° C./min.] to 10 [° C./min.]. When the cooling rate is slower than 1 [° C./min.], since the cooling rate is too slow and the gap between the α2-phase and the γ-phase within the lamella grain becomes coarse, the high-temperature strength such as creep strength may be deteriorated. When the cooling rate exceeds 10 [° C./min.], since the cooling rate is too fast and the ratio of the α2-phase is too large, the ductility may be deteriorated.

Specifically, the method for producing the TiAl-based alloy according to the first embodiment of the present invention is as follows. First, the ingot having the composition described above is melted. Subsequently, the ingot is subjected to hot forging. That is, similarly with the conventional hot-forged TiAl alloy, after being held in an coexisting region of the α-phase and the β-phase, the ingot is taken out of the furnace and is subjected to the hot forging for working at a high strain rate while being rapidly cooled. In this case, similarly with the hot forged material of the conventional TiAl-based alloy, the hot forgeability can be ensured due to the effect that the β-phase rich in plastic deformability exists. In addition, due to the effect that plastic strain is imparted by the hot forging, the crystal grain size becomes finer.

Subsequently, the hot-forged material is subjected to a heat treatment. In the heat treatment, the material is held for a predetermined time at the α-single phase region, and thus the β-phase existing in the forged material is eliminated and the α-single phase is obtained. Then, by cooling of the forged material at a predetermined rate, transformation of α→α+γ→α2+γ occurs. The crystal grain is not coarsened by optimization of the holding time at the α-region, and it is possible to obtain a perfect lamellar structure laminated with the α2-phase and the γ-phase, which are fine grains and are finally excellent in high-temperature strength and room-temperature ductility, by optimization of the cooling rate. Unlike the hot forging material of the conventional TiAl-based alloy, the alloy of the present invention is characterized by not including the β-phase in the final state.

In the first embodiment of the present invention, the alloy composition has compositions different from the conventional hot-forged TiAl material, and specifically, the alloy element parameter "P=(41−Al)/3+0.25Nb+0.8Cr−0.8Si−1.7C" is in the range of from 1.1 atom % to 2.3 atom %. By this alloy composition, a phase transformation process (α+β→α→α+γ→α2+γ) is realized, which is not realized in the conventional hot forged material, and it is possible to obtain the perfect lamellar structure laminated with the α2-phase and the γ-phase, in which the β-phase is not included in the final state and the high-temperature strength is high, using the phase transformation in the processes of the hot forging and the heat treatment. That is, both of the hot forgeability and the high-temperature strength are balanced. In addition, due to the effect that plastic strain is imparted by the hot forging, the crystal grain becomes finer and thus the room-temperature ductility, the impact properties, and the like are significantly superior to those of the casting material.

A TiAl-based alloy according to a second embodiment of the present invention consists of Al: 40.0 to 42.8 atom % and a Cr equivalent being 1.2 to 2.0 atom % that is obtained by the following formula, and the balance Ti with inevitable impurities, $$\text{Cr equivalent}=\text{Cr}+\text{Mo}+0.5\text{Mn}+0.25\text{Nb}+0.25\text{V}.$$

The TiAl-based alloy is characterized by having a fine structure of densely arranged lamella grains that are laminated alternately with a α2-phase and a γ-phase and have an average grain size of 30 to 200 μm.

The other aspect of the TiAl-based alloy according to the second embodiment of the present invention is a TiAl-based alloy in which at least one element selected from the group consisting of C, Si, W, B, Ta, and Zr is further contained in the above TiAl-based alloy to be 0.1 to 3 atom % in total. By the addition of these elements, it is possible to increase high-temperature strength, creep strength, and oxidation resistance.

A method for producing the TiAl-based alloy according to the second embodiment of the present invention that has the fine structure of densely arranged lamella grains that are laminated alternately with the α2-phase and the γ-phase and have the average grain size of 30 to 200 μm, the method includes:

a process in which the TiAl-based alloy material is held at a coexisting temperature range of an α-phase and a β-phase and is then subjected to hot forging, the TiAl-based alloy material consisting of Al: 40.0 to 42.8 atom % and a Cr equivalent being 1.2 to 2.0 atom % that is obtained by the following formula, and the balance Ti with inevitable impurities;

Cr equivalent=Cr+Mo+0.5Mn+0.25Nb+0.25V, and a process in which the hot-forged TiAl-based alloy material is held in a temperature range of from 1180° C. to 1260° C. for 0.5 to 20 hours and is subjected to a heat treatment at a cooling rate of from 0.3 [° C./min.] to 10 [° C./min.] at the same time.

In the TiAl-based alloy according to the second embodiment of the present invention, when the content of Al is in the range of from 40.0 atom % to 42.8 atom %, it is preferred because the β-phase does not exist in a final state after the heat treatment and a perfect lamellar structure of the α2/γ is obtained. In addition, since the (α+β) phase is obtained during forging, it is preferred because the hot forgeability is excellent. The excellence in the hot forgeability means that large cracks do not occur even when the hot forging is performed under conditions illustrated in FIGS. 21(A) and 21(C) in particular and fine cracks caused by the change in surface structure of oxidation or the like are not included. When the content of Al is less than 40.0 atom %, the forgeability is good and the β-phase does not remain, but the ratio of the α2-phase becomes too high. Thus, in this case, the room-temperature ductility may be deteriorated. When the content of Al exceeds 42.8 atom %, the forgeability may become poor.

In the TiAl-based alloy according to the second embodiment of the present invention, the Cr equivalent is preferably in the range of from 1.2 atom % to 2.0 atom %. When the Cr equivalent is less than 1.2 atom %, since the amount of β-phase is deficient during the forging, the forgeability may become poor. When the Cr equivalent exceeds 2.0 atom %, since the β-phase remains after the heat treatment, the high-temperature strength is low and the available temperature may be lowered.

Elements included in the relation equation of the Cr equivalent have different addition effects, respectively, but when the Cr equivalent is in the above range, it is preferred because the forgeability is good and the β-phase does not also remain.

In the TiAl-based alloy according to the second embodiment of the present invention, the crystal grain size of the lamella grain is preferably 200 μm or less because the room-temperature ductility is ensured. It is industrially difficult to make the average grain size of the lamella grain to be less than 30 μm, and the room-temperature ductility may be reduced when the average grain size exceeds 200 μm.

In the method for producing the TiAl-based alloy according to the second embodiment of the present invention, when the hot-forged TiAl-based alloy material is subjected to the heat treatment at the (α+β) region, the temperature range in which the hot-forged TiAl-based alloy is held in the equilibrium temperature range of the α-single phase region is preferably from 1180° C. to 1260° C. When the temperature range is lower than 1180° C., since it is within the (α+γ) region, the α-single phase is not obtained and the perfect lamellar structure may not be formed after cooling. When the temperature range exceeds 1260° C., since it is within the (α+γ) region, the β-phase may remain by the cooling rate.

In the method for producing the TiAl-based alloy according to the second embodiment of the present invention, when the hot-forged TiAl-based alloy material is subjected to the heat treatment, the time at which the hot-forged TiAl-based alloy material is held within the equilibrium temperature range of the α-single phase region is preferably from 0.5 hours to 20 hours. When the holding time is shorter than 0.5 hours, the time is too short and thus the α-single phase may not be obtained. When the holding time exceeds 20 hours, the time is too long and thus the crystal grain size of the α-grain (final lamella grain) may be coarsened.

In the method for producing the TiAl-based alloy according to the second embodiment of the present invention, the cooling rate after the hot-forged TiAl-based alloy material is held for a predetermined holding time within the equilibrium temperature range of the α-single phase region is preferably from 0.3 [° C./min.] to 10 [° C./min.]. When the cooling rate is slower than 0.3 [° C./min.], since the cooling rate is too slow and the gap between the α2-phase and the γ-phase within the lamella grain is coarsened, the ductility and the strength may be deteriorated. When the cooling rate exceeds 10 [° C./min.], since the cooling rate is too fast and the ratio of the α2-phase is too large, the ductility may be deteriorated.

Specifically, the method for producing the TiAl-based alloy according to the second embodiment of the present invention is as follows. First, the ingot having a predetermined composition is melted. Subsequently, the ingot is subjected to hot forging. That is, similarly with the conventional hot-forged TiAl alloy, the forging is performed at the (α+β) region. Similarly with the conventional material, the hot forgeability can be ensured by the effect of the β-phase. In addition, the crystal grain size becomes finer by the effect of the forging.

Subsequently, the hot-forged material is subjected to a heat treatment. When the material is cooled at a predetermined rate after being held for a predetermined time at the α-single phase region, transformation of a α→α+γ→α2+γ occurs. The crystal grain is not coarsened by optimization of the holding time at the α-region, and it is possible to obtain a perfect lamellar structure of the α2/γ, which are fine grains and are finally excellent in high-temperature strength and room-temperature ductility.

In the second embodiment of the present invention, the composition is largely changed compared to the conventional hot-forged TiAl material. By this composition, a phase transformation process (α+β→α→α+γ→α2+γ) is realized, which is not realized in the conventional hot forged material, and it is possible to obtain the perfect lamellar structure of the α2/γ, in which the high-temperature strength is high in the final state, using the phase transformation in the processes of the forging and the heat treatment. That is, both of the hot forgeability and the high-temperature strength are balanced. In addition, the crystal grain becomes finer due to the effect of the forging and thus the room-temperature ductility is significantly superior to that of the casting material.

EXAMPLE

The present invention will be described below with reference to the accompanying drawings.

FIGS. 1(A) to 17 relate to a first embodiment of the present invention, and FIGS. 18 to 25 relate to a second embodiment of the present invention. In addition, FIGS. 26 to 32 relate to a TiAl-casting material and a conventional hot-forged TiAl material as Comparative Example.

First, preparation procedures and evaluation test procedures of a hot-forged TiAl alloy according to the first embodiment of the present invention will be sequentially described in detail.

Procedure 1: Ingot Preparation

FIGS. 1(A) to 1(C) illustrate an ingot used in Example and a hot forging test for evaluating hot forgeability; FIG. 1(A) illustrates an appearance photograph of the ingot and a cutting position (using a lower side) of a material subjected to a forging test, FIG. 1(B) is a circumstantial photograph during the hot forging test, and FIG. 1(C) is an explanatory view of a change of height in the hot forging test.

FIG. 1(A) is a representative example of the appearance of the ingot prepared by alloy compositions illustrated in FIGS. 2 and 3. All of the ingots have almost the same appearance. FIGS. 2 and 3 are diagrams illustrating compositions of trial ingots and summaries of evaluation test results of the trial ingots. The ingot is prepared by high-frequency melting using an yttria crucible. A raw material of the ingot includes sponge Ti, granular raw materials of Al, Nb, Cr, and Si, and C added in the form of a TiC powder, and the total weight is about 700 g. A melting atmosphere is in argon gas. Casting was performed using a cast iron mold having an inner diameter of ϕ 40 mm, cutting is performed at the position illustrated in FIG. 1(A), and the lower side is subjected to the hot forging test. The weight of the ingot in the photograph was about 700 g, but the weight of the ingot after riser cutting was about 450 g.

Procedure 2: Measurement of an Area Ratio of a β-Phase Existing at 1350° C. (Heating Temperature During Hot Forging)

With respect to the ingot prepared in the above procedure 1, a small piece was worked from an upper portion the cut plane of the ingot, and was subjected to a water-cooling treatment after being held at 1350° C. for one hour. Subsequently, a cross-sectional structure of the test material subjected to the water-cooling treatment was observed by a reflected electron image of a scanning electron microscope, and the resulting photograph was subjected to an image treatment, whereby the area ratio of the β-phase existing in the test material was measured.

Procedure 3: Hot Forging Test

The hot forging test was performed in the same manner as the circumstantial photograph illustrated in FIG. 1(B) and the explanatory view illustrated in FIG. 1(C). That is, the heating temperature was 1350° C., the ingot was taken out of the furnace and was placed in a press, and forging was performed by descending of the press. The descending speed of the press was 50 mm/second or faster, the forging direction was upset, and the number of times of the forging was seven times. The material returned to the furnace every each forging and was subjected to reheating. In the hot forging test, the height was changed into 90 mm (initial height of the ingot), 80 mm, 70 mm, 55 mm, 40 mm, 30 mm, 20 mm, and 15 mm, and compression was performed in this order.

Procedure 4: Investigation on Presence or Absence of β-Phase Remaining in Each Composition After being held at 1350° C. for two hours, the hot-forged test material was subjected to an annealing treatment for cooling at 0.2° C./min., and cross-sectional structure thereof was observed by a reflected electron image of the scanning electron microscope, whereby the presence or absence of the β-phase remaining was investigated. This heat treatment was intended to investigate whether the β-phase was ultimately stabilized in each composition of FIGS. 2 and 3, and thus the annealing treatment was performed for the purpose. In addition, this heat treatment is independent of heat treatment conditions after the forging which is a requirement of the present invention.

Procedure 5: Investigation of Appropriate Heat Treatment Conditions

The hot forged material after the above procedure 3 was subjected to a heat treatment test by changing of the following conditions, and appropriate heat treatment conditions were investigated from structure observation. The changed conditions include a holding temperature, a holding time, and a cooling rate.

As a result, with respect to the alloy of the first embodiment according to the present invention, that is, the hot-forged TiAl alloy having an alloy element parameter P (=(41−Al)/3+0.25Nb+0.8Cr−0.8Si−1.7C) in the range of from 1.1 atom % to 2.3 atom %, it was found that the temperature range of the holding temperature for holding the alloy in an equilibrium temperature range of α-single phase region was preferably 1230 to 1290° C.

It was found that the holding time was a time for holding the hot-forged TiAl-based alloy within the equilibrium temperature range of the α-single phase region and was preferably 1 to 20 hours.

It was found that the cooling rate was a cooling rate of the alloy after the hot-forged TiAl-based alloy was held in the equilibrium temperature range of the α-single phase region for a predetermined time, and was preferably 1 to 10 [° C./min.].

Subsequently, in the Procedure 5 of Investigation of appropriate heat treatment conditions, an appropriate structure is determined as follows. That is, an object of structure is a fine structure in which lamella grains are densely arranged, the lamella grains being alternately laminated with an α2-phase of gray in the reflected electron image and a γ-phase of black in the reflected electron image and having an average grain size of 1 to 200 μm. In addition, a β-phase of white in the reflected electron image or a γ-grain in which the equi-axied γ-phase of black in the reflected electron image is largely grown is not included. Silicide of a small white granular shape in the reflected electron image is outside the scope of the evaluation determination, the silicide being precipitated along with the addition of Si.

Procedure 6: Evaluation Creep Rupture Strength

After the hot forged material was subjected to the heat treatment, a creep test piece was worked and was subjected to a creep rupture test in a state of 870° C.×225 MPa. Then, creep strength of each alloy was evaluated by a rupture time. The inventive alloy was subjected to the heat treatment under heat treatment conditions to obtain the object of structure in the procedure 5. Further, Comparative Alloys (alloys in which the β-phase remains in the procedure 4) is treated under the appropriate conditions in the inventive alloy having an analogous composition.

FIG. 4 is an explanatory view illustrating a relation between an alloy element parameter "P=(41−Al)/3+0.25Nb+0.8Cr−0.8 Si−1.7C" of a trial ingot of the present invention and a forging test result at 1350° C. measured in the procedure 3 and a relation between the area ratio of the β-phase of a material, which is water-cooled in the condition of 1350° C.×1 h, measured in the above procedure 2 and the forging test result. In FIG. 4, each plot corresponds to a separate ingot having a different composition, and a state of crack occurrence in the hot forging is indicated by a black-plotted mark or a void-plotted mark. During the hot forging test, the crack occurs in the case of the ingot having a composition of the black-plotted mark, and the crack does not occur in the case of the ingot having a composition of the void-potted mark.

From FIG. 4, it can be confirmed that the correlation between the alloy element parameter "P=(41−Al)/3+

0.25Nb+0.8Cr−0.8Si−1.7C" and the area ratio of the β-phase of the material which is water-cooled in the condition of 1350° C.×1 h is good. In addition, the relation between the hot forgeability and the area ratio of the β-phase of the material which is water-cooled in the condition of 1350° C.×1 h and the relation between the alloy element parameter P and the area ratio of the β-phase of the material which is water-cooled in the condition of 1350° C.×1 h are as follows. An ingot having a composition in which the alloy element parameter P is 1.1 atom % or less and the area ratio of the β-phase of the material which is water-cooled in the condition of 1350° C.×1 h is 30% or less has poor hot forgeability. On the other hand, an ingot having a composition in which the alloy element parameter P is 1.1 atom % or more and the area ratio of the β-phase of the material which is water-cooled in the condition of 1350° C.×1 h is 30% or more has excellent hot forgeability.

Figure 5:
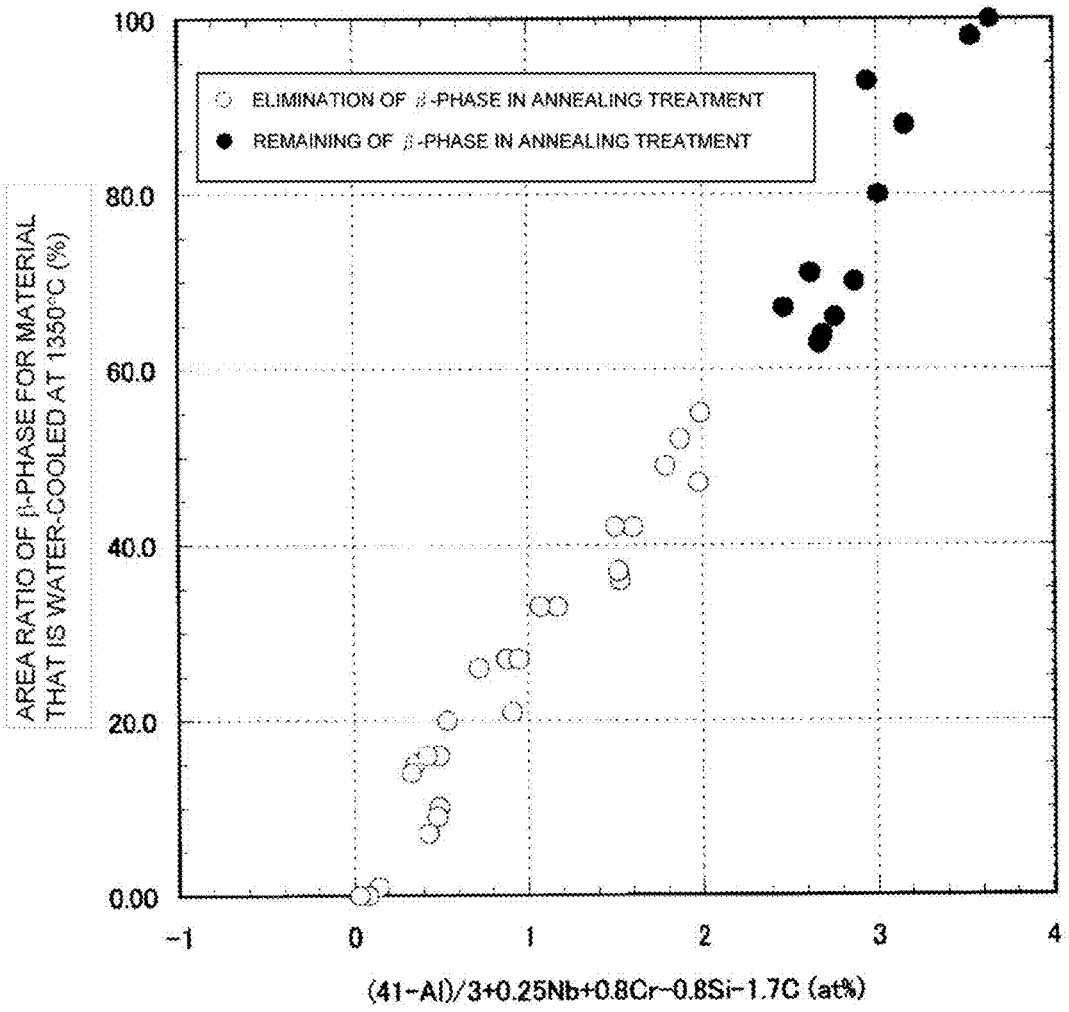
FIG. 5 is an explanatory view illustrating a relation among an alloy element parameter P of a trial ingot, an area ratio of a β-phase existing in a material, which is water-cooled in a condition of 1350° C.×1 h (procedure 2), and the presence or absence of a β-phase residue in the case of being subjected to annealing at 0.2° C./min. after being held at 1350° C. for 2 h (procedure 4).

FIG. 5 is an explanatory view illustrating a relation between an alloy element parameter "P=(41−Al)/3+0.25 Nb+0.8Cr−0.8Si−1.7C" of the trial ingot of the present invention and the presence or absence of the β-phase residue in an annealing treatment evaluated in the procedure 4 (whether the β-phase is finally stable in each composition) and a relation between the area ratio of the β-phase of a material, which is water-cooled in the condition of 1350° C.×1 h, measured in the above procedure 2 and the presence or absence of the β-phase residue.

The relation between the presence or absence of the β-phase residue and the alloy element parameter P and the relation between the presence or absence of the β-phase residue and the area ratio of the β-phase of a material, which is water-cooled in the condition of 1350° C.×1 h, are as follows. In an ingot having a composition in which the alloy element parameter P is 2.3 atom % or less and the area ratio of the β-phase of the material which is water-cooled in the condition of 1350° C.×1 h is 60% or less, the β is eliminated after the annealing treatment. That is, in this composition, the β-phase is finally unstable. On the other hand, in an ingot having a composition in which the alloy element parameter P is 2.3 atom % or more and the area ratio of the β-phase of the material which is water-cooled in the condition of 1350° C.×1 h is 60% or more, the β remains after the annealing treatment. That is, in this composition, the β-phase is finally stable.

From the above results illustrated in FIGS. 4 and 5, it is possible to evaluate the hot forgeability and the influence of the alloy composition on the stability of the final β-phase using the alloy element parameter "P=(41−Al)/3+0.25Nb+0.8Cr−0.8Si−1.7C". It could be confirmed that the hot forgeability was excellent and the β-phase did not finally remain when the parameter was in the range of from 1.1 atom % to 2.3 atom %.

The hot forged materials of the ingots prepared by the compositions illustrated in FIGS. 2 and 3 will be described in detail below based on typical cases by being divided into Examples and Comparative Examples.

Example 1

Figure 6:
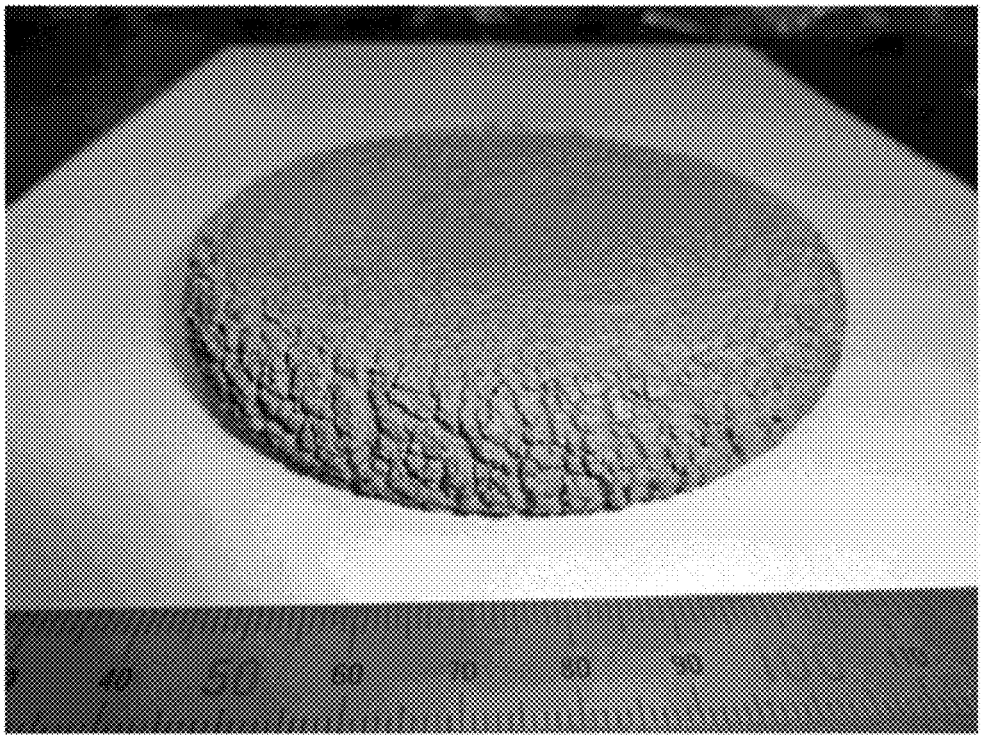
FIG. 6 is an appearance photograph of a hot-forged TiAl alloy according to the first embodiment of the present invention which is subjected to hot forging at 1350° C.

FIG. 6 is an appearance photograph when an ingot (alloy 13 having a composition of Ti-42Al-8Nb-2.3Cr-0.9Si-0.7C (atom %)) according to the first embodiment of the present invention is subjected to the hot forging at 1350° C. Since it is estimated that the amount of β-phase at 1350° C. is 42% much larger than that in the evaluation in the procedure 2, forgeability is good, and no crack occurs.

Figure 7:
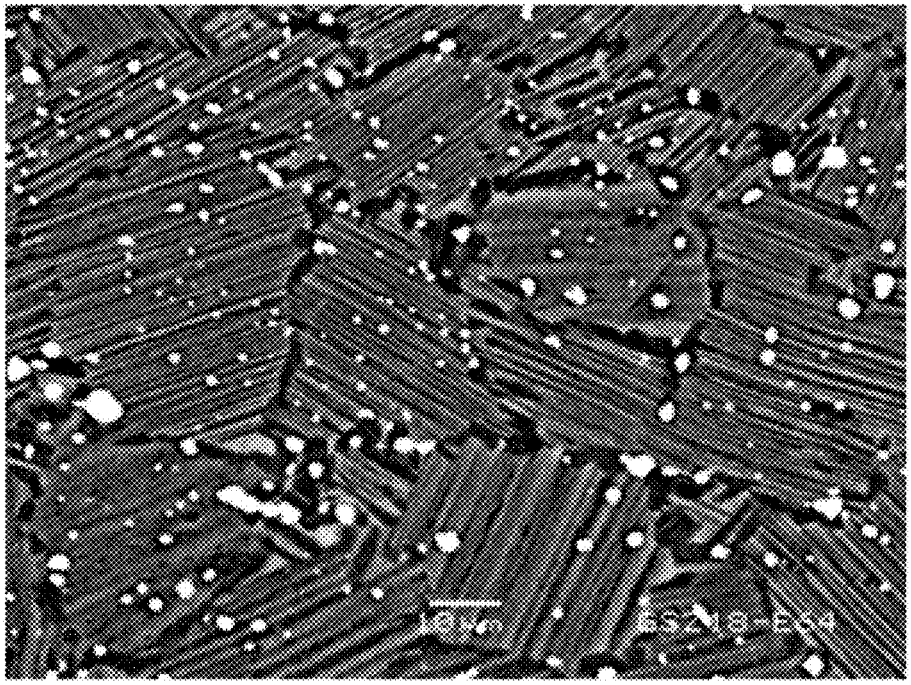
FIG. 7 is a reflected electron image photograph of a cross-sectional structure for the hot forged TiAl alloy according to the first embodiment of the present invention which is heat-treated under appropriate conditions after being subjected to the hot forging.

FIG. 7 is a reflected electron image photograph of a test material obtained in such a manner that the ingot (alloy 13) according to the first embodiment of the present invention is heat-treated under appropriate conditions after being subjected to the hot forging. A perfect lamellar structure having no β-phase (large white phase) appears in the photograph. Fine white points indicate precipitates (silicide) caused by Si. Here, the appropriate conditions refer to the heat-treatment conditions described above.

That is, when the alloy 13 subjected to the hot forging is heat-treated under the appropriate conditions, the β-phase existing in the hot forged material is no longer present in the alloy, the β-phase having excellent high temperature deformability (low high-temperature strength). The grain size is slightly coarsened compared to that of the forged alloy, but becomes significantly smaller than that of a casting material. Therefore, since this hot forged material has the above structure, it is excellent in both of the high-temperature strength and the room-temperature ductility.

Comparative Example 1

Figure 8:
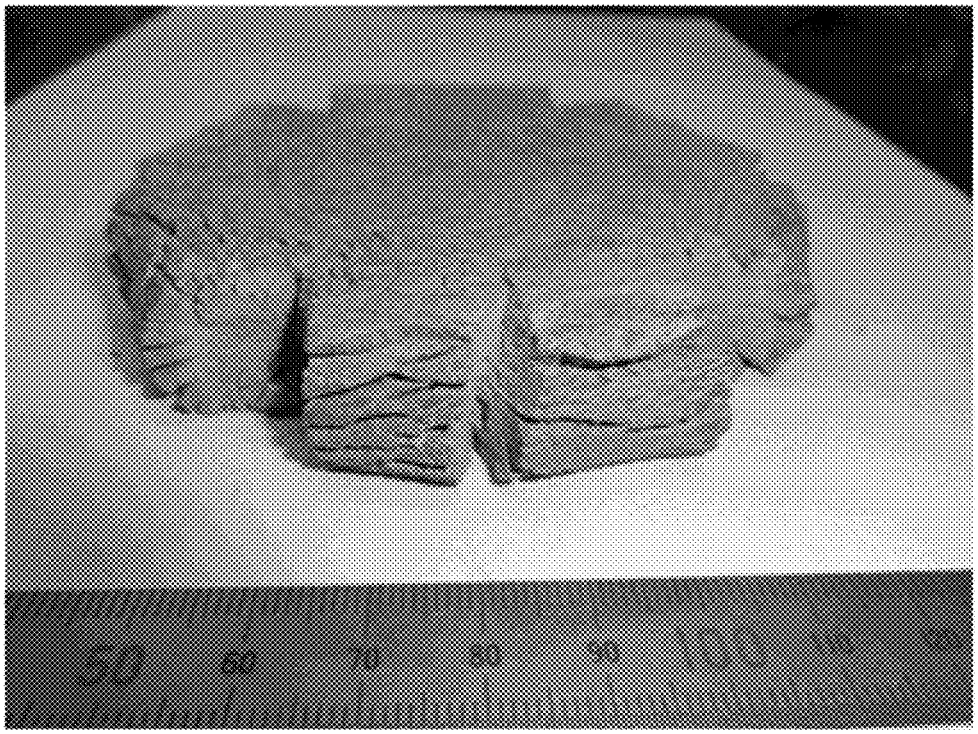
FIG. 8 is an appearance photograph of a hot-forged TiAl alloy of an alloy 6 as Comparative Example which is subjected to hot forging at 1350° C.

FIG. 8 is an appearance photograph when an ingot (composition: Ti-41Al-7Nb-0.9Si-0.4C (atom %)) of Comparative Alloy 6 is subjected to the hot forging at 1350° C. Since it is estimated that the amount of β-phase at 1350° C. is 12% smaller than that in the evaluation in the procedure 2, deformability is poor, and large cracks have occurred.

Figure 9:
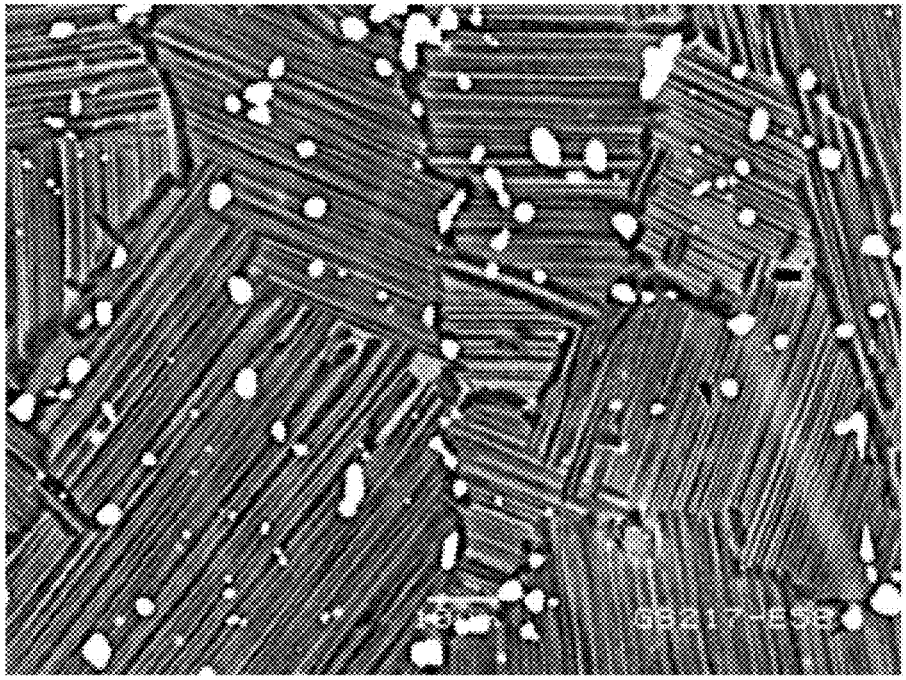
FIG. 9 is a reflected electron image photograph of a cross-sectional structure for the hot-forged TiAl alloy of the alloy 6 as Comparative Example which is heat-treated under appropriate conditions after being subjected to the hot forging.

FIG. 9 is a photograph of a reflected electron image structure of a test material obtained in such a manner that the forged TiAl material of Comparative Alloy 6 is heat-treated under appropriate conditions. Similarly to the inventive alloy, a perfect lamellar structure having no β-phase (large white phase) appears in the photograph. Fine white points indicate precipitates (silicide) caused by Si.

Comparative Example 2

Figure 10:
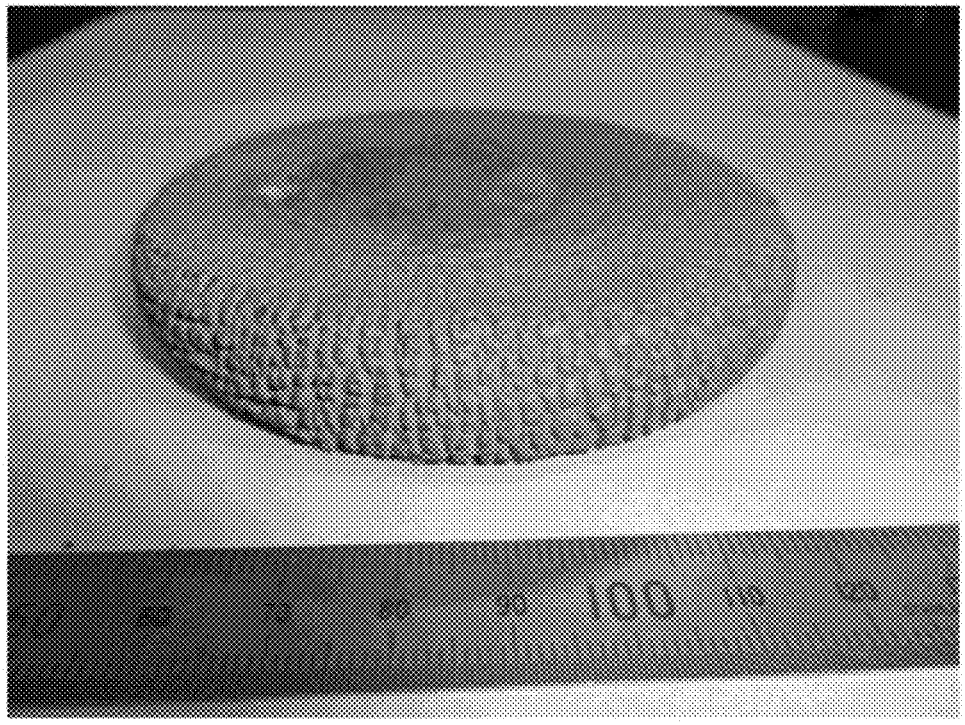
FIG. 10 is an appearance photograph of a hot-forged TiAl alloy of an alloy 17 as Comparative Example which is subjected to hot forging at 1350° C.

FIG. 10 is an appearance photograph when an ingot (composition: Ti-40Al-7Nb-3Cr-0.6Si-0.9C (atom %)) of Comparative Alloy 4 is subjected to the hot forging at 1350° C. Since it is estimated that the amount of β-phase at 1350° C. is 63% much larger than that in the evaluation in the procedure 2, forgeability is good, and no crack occurs.

Figure 11:
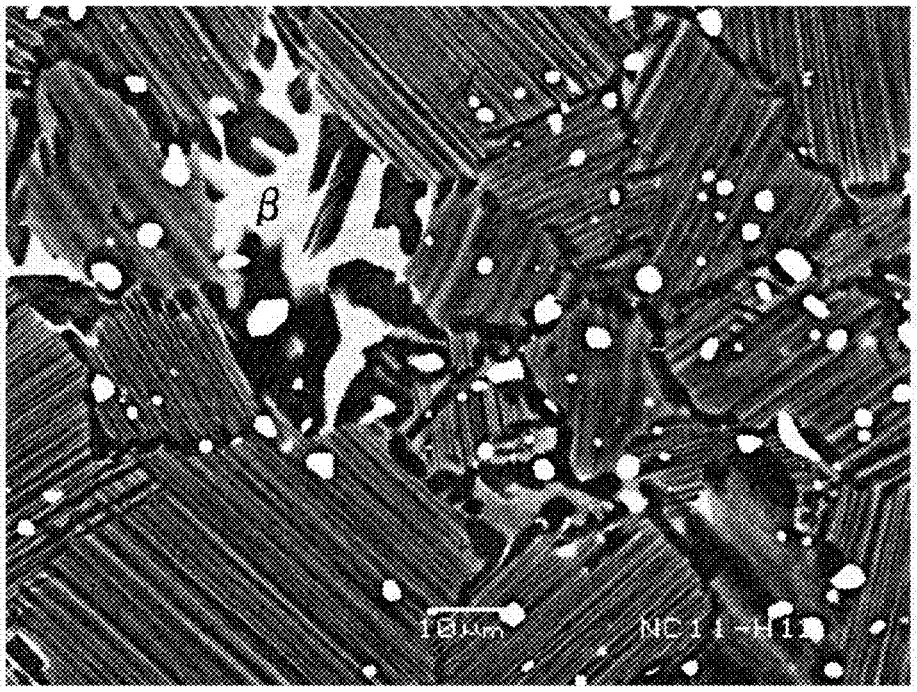
FIG. 11 is a reflected electron image photograph of a cross-sectional structure for the hot-forged TiAl alloy of the alloy 17 as Comparative Example which is heat-treated under appropriate conditions after being subjected to the hot forging.

FIG. 11 is a photograph of a reflected electron image structure of a test material obtained in such a manner that the ingot of Comparative Alloy 4 is heat-treated under appropriate conditions after being subjected to the hot forging. Since a β-phase (large white phase) having excellent high temperature deformability (low high-temperature strength) remains, it is assumed that the high-temperature strength is low. In fact, a creep rupture time (h) in a state of 870° C.×225 MPa is 16 hours which is shorter than that in the inventive alloy.

Comparative Example 3

Figure 12:
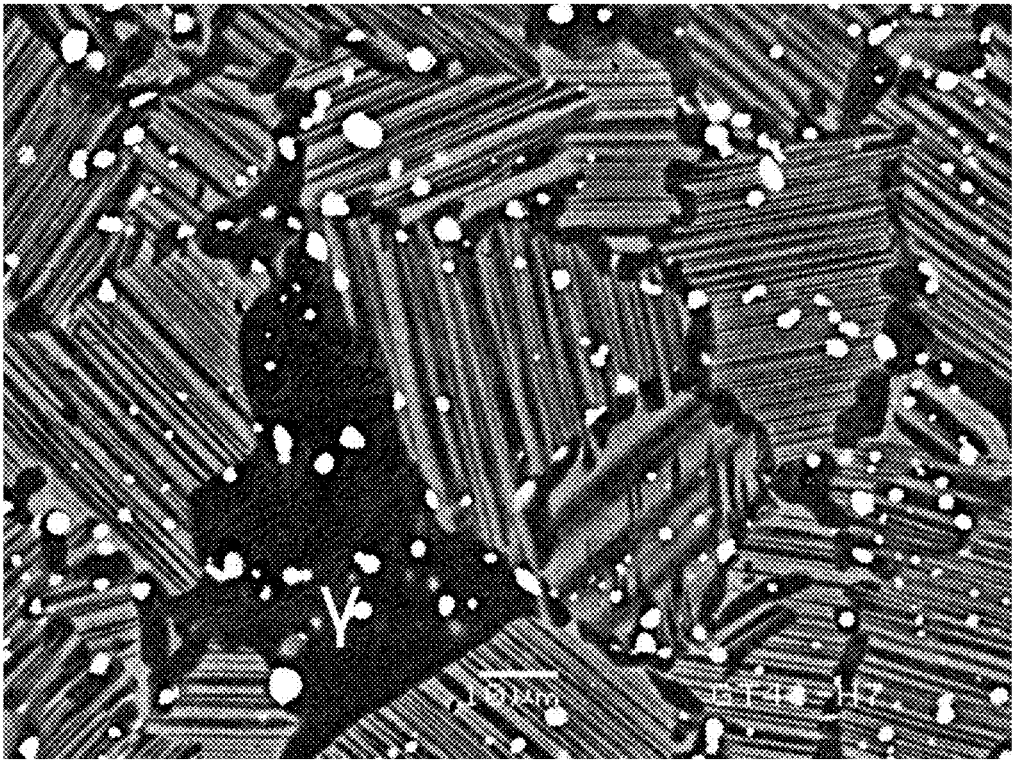
FIG. 12 is a reflected electron image photograph of a cross-sectional structure for the hot-forged TiAl alloy according to the first embodiment of the present invention, as Comparative Example, which is held at 1220° C. lower than an appropriate holding temperature in a heat treatment. Other heat treatment conditions are appropriate conditions.

FIG. 12 is a reflected electron image photograph of a test material obtained in such a manner that the ingot (alloy 13) according to the first embodiment of the present invention is held at 1220° C. lower than the appropriate holding temperature in a heat treatment after being subjected to the hot forging. Other heat treatment conditions are appropriate conditions. It is found that a large black equi-axied γ-phase exists. That is, since a perfect lamellar structure is not formed, it is considered that the high-temperature strength is lower than that of the inventive alloy. This is considered because the holding temperature of 1220° C. is within a (α+γ) region rather than an α-single phase region.

Comparative Example 4

Figure 13:
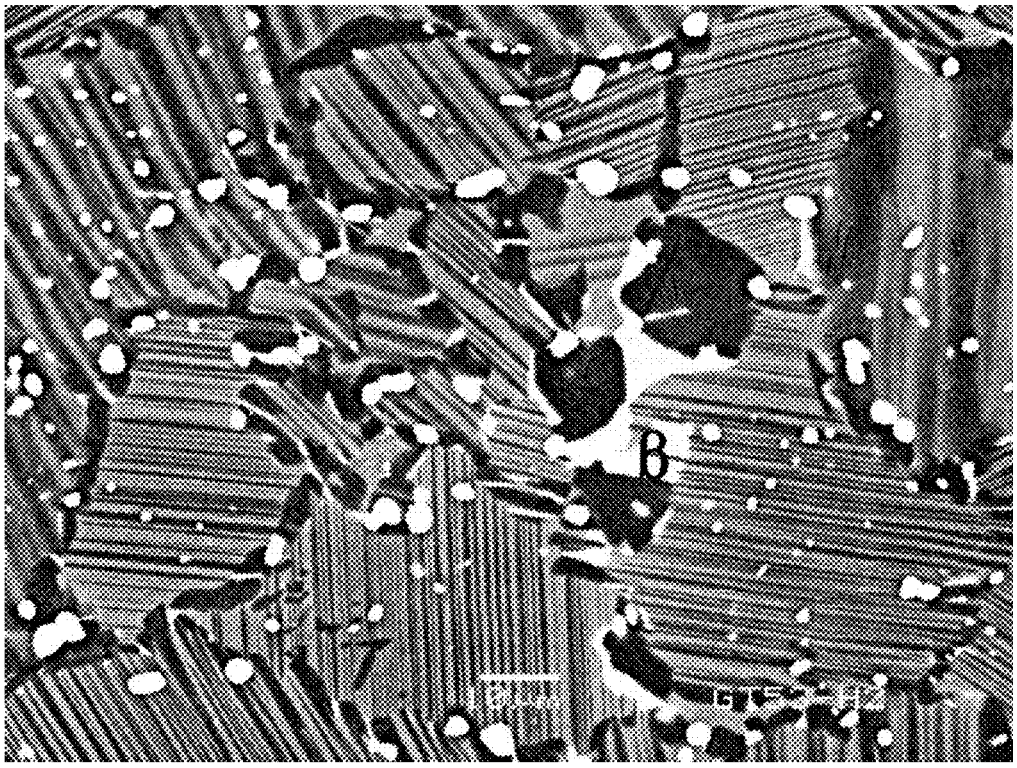
FIG. 13 is a reflected electron image photograph of a cross-sectional structure for the hot-forged TiAl alloy according to the first embodiment of the present invention, as Comparative Example, which is held at 1300° C. higher than the appropriate holding temperature in a heat treatment. Other heat treatment conditions are appropriate conditions.

FIG. 13 is a reflected electron image photograph of a test material obtained in such a manner that the ingot (alloy 13) according to the first embodiment of the present invention is held at 1300° C. higher than the appropriate holding temperature in a heat treatment after being subjected to the hot forging. Other heat treatment conditions are appropriate conditions. It is found that a large white β-phase exists. Since the β-phase remains, it is considered that the high-temperature strength is lower than that of the inventive alloy. This is considered because the holding temperature of 1300° C. is within a (α+β) region rather than an α-single phase region.

Comparative Example 5

Figure 14:
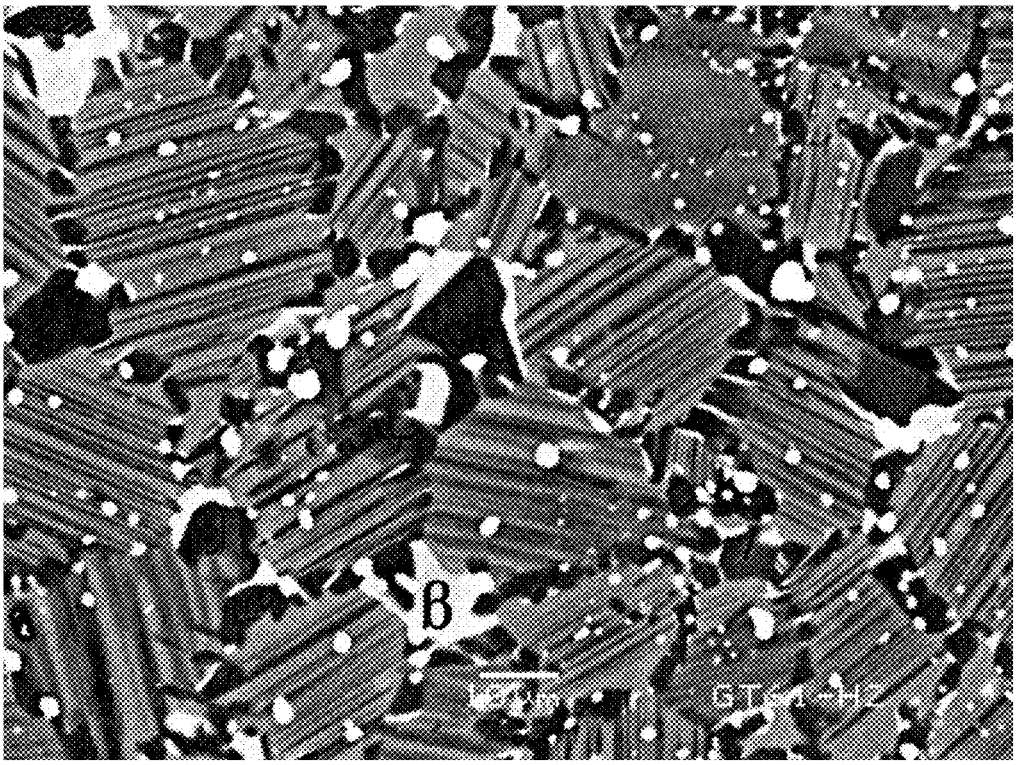
FIG. 14 is a reflected electron image photograph of a cross-sectional structure for the hot-forged TiAl alloy according to the first embodiment of the present invention, as Comparative Example, which is held for 0.5 hours shorter than the appropriate holding time in a heat treatment. Other heat treatment conditions are appropriate conditions.

FIG. 14 is a reflected electron image photograph of a test material obtained in such a manner that the ingot (alloy 13) according to the first embodiment of the present invention is held for 0.5 hours shorter than the appropriate holding time in a heat treatment after being subjected to the hot forging. Other heat treatment conditions are appropriate conditions. It is found that a large white β-phase exists. Since the β-phase remains, it is considered that the high-temperature strength is lower than that of the inventive alloy. This is considered because the holding time is short and thus a sufficient time for transformation of the β-phase existing in the forged material into the α-phase is not left.

Comparative Example 6

Figure 15:
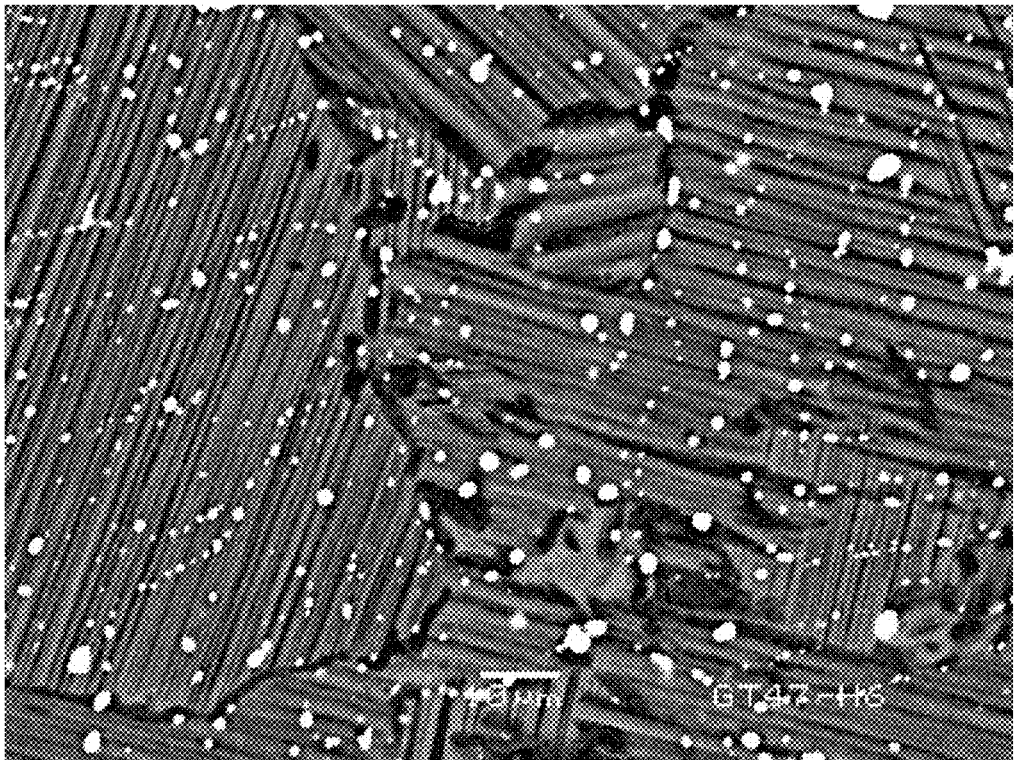
FIG. 15 is a reflected electron image photograph of a cross-sectional structure for the hot-forged TiAl alloy according to the first embodiment of the present invention, as Comparative Example, which is held for 23 hours longer than the appropriate holding time in a heat treatment. Other heat treatment conditions are appropriate conditions.

FIG. 15 is a reflected electron image photograph of a test material obtained in such a manner that the ingot (alloy 13) according to the first embodiment of the present invention is held for 23 hours longer than the appropriate holding time in a heat treatment after being subjected to the hot forging. Other heat treatment conditions are appropriate conditions. It is found that a perfect lamellar structure is formed, but a crystal grain is large. Since the crystal grain is large, it is considered that the room-temperature ductility or the like is lower than that of the inventive alloy. This is considered because the holding time is long and thus an α-grain (lamellar grain after cooling) is coarsened during the holding.

Comparative Example 7

Figure 16:
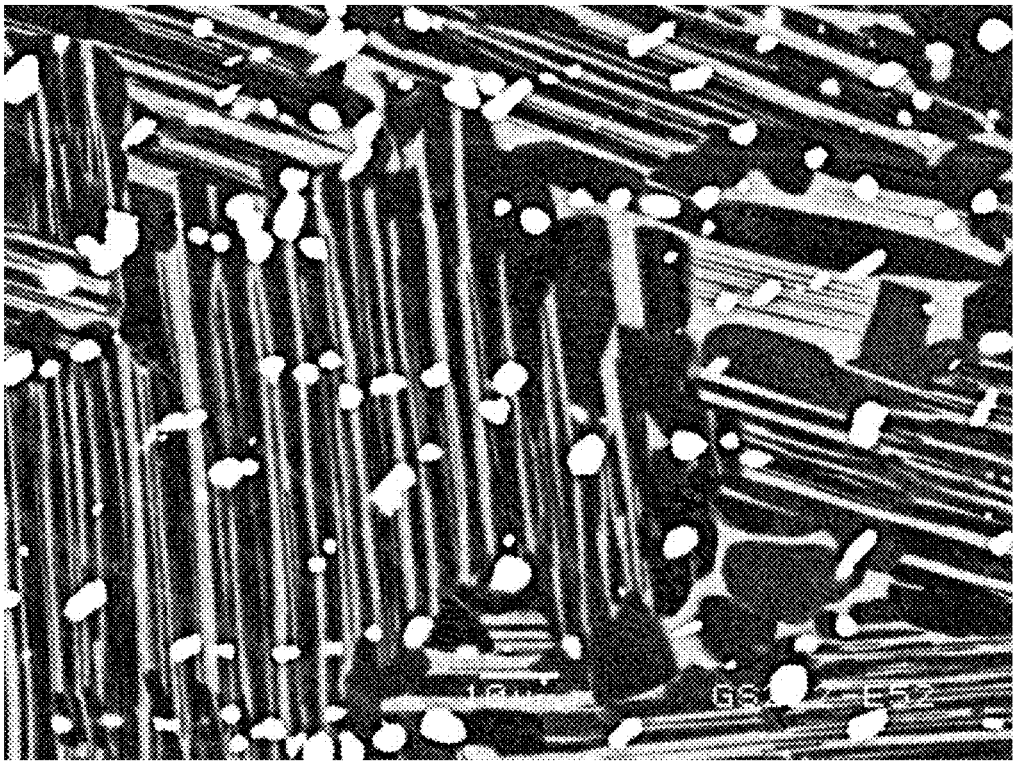
FIG. 16 is a reflected electron image photograph of a cross-sectional structure for the hot-forged TiAl alloy according to the first embodiment of the present invention, as Comparative Example, which is cooled at 0.7 [° C./min.] slower than the appropriate cooling rate in a heat treatment. Other heat treatment conditions are appropriate conditions.

FIG. 16 is a reflected electron image photograph of a test material obtained in such a manner that the ingot (alloy 13) according to the first embodiment of the present invention is cooled at 0.7 [° C./min.] slower than the appropriate cooling rate in a heat treatment after being subjected to the hot forging. Other heat treatment conditions are appropriate conditions. It is found that a perfect lamellar structure is formed, but a lamella gap is large. Since the lamella gap is large, it is considered that the high-temperature strength is lower than that of the inventive alloy.

Comparative Example 8

Figure 17:
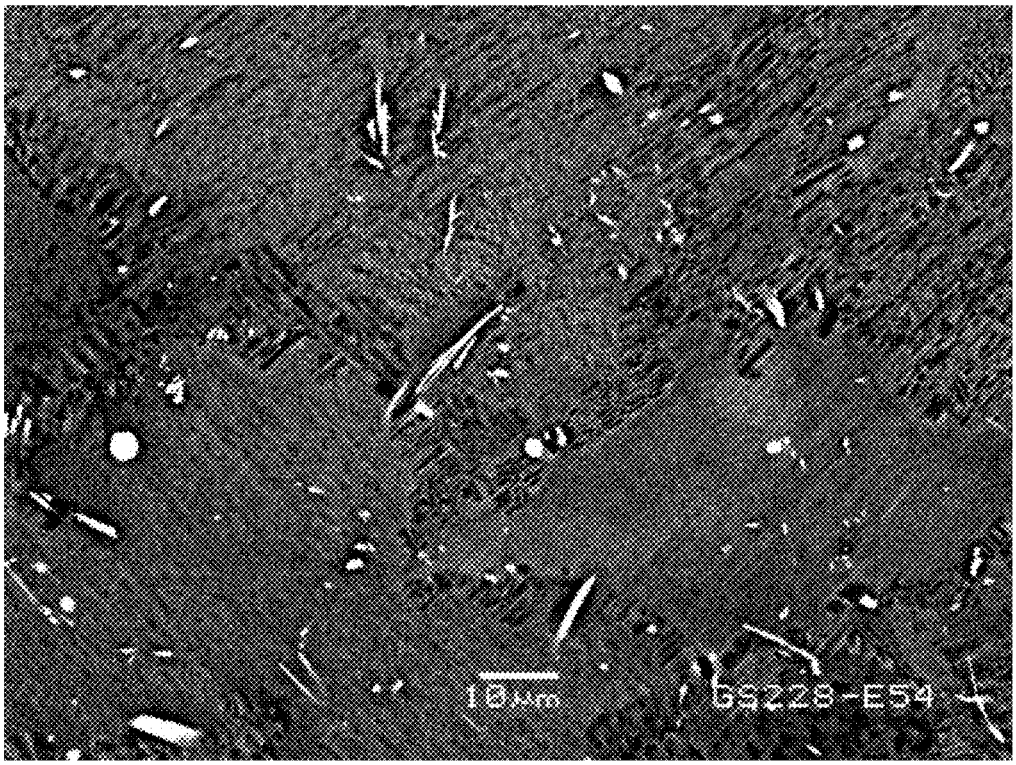
FIG. 17 is a reflected electron image photograph of a cross-sectional structure for the hot-forged TiAl alloy according to the first embodiment of the present invention, as Comparative Example, which is cooled at 15 [° C./min.] faster than the appropriate cooling rate in a heat treatment. Other heat treatment conditions are appropriate conditions.

FIG. 17 is a reflected electron image photograph of a test material obtained in such a manner that the ingot (alloy 13) according to the first embodiment of the present invention is cooled at 15 [° C./min.] faster than the appropriate cooling rate in a heat treatment after being subjected to the hot forging. Other heat treatment conditions are appropriate conditions. It is found that a perfect lamellar structure is formed, but a lamella gap is small. Since the lamella gap is small, it is considered that the room-temperature ductility or the like is lower than that of the inventive alloy.

Example 2

Table 1 indicates a composition, a hot forging temperature, a heat-treatment condition, a structure, and tensile properties at a room temperature, 850° C., and 950° C. with respect to a hot-forged TiAl alloy according to a second embodiment of the present invention, a material of Comparative Example 9 as a TiAl-casting material, and a material of Comparative Example 10 as a conventional hot-forged TiAl material.

TABLE 1

Compare tensile properties to each other in materials of present invention and Comparative Examples

| | | | | | | | Structure | |
|---|---|---|---|---|---|---|---|---|
| | | | Hot forging | Heat-treatment condition | | | Structure state | Average |
| | Material | Composition (at %) | temperature (° C.) | Temperature (° C.) | Time (h) | Cooling rate (° C./min) | and constituting phase | grain size (μm) |
| Comparative Example 9 | TiAl-forged material | Ti—46Al | — | — | — | — | α2/γ-perfect lamellar structure | 1200 |
| Comparative Example 10 | Conventional hot-forged TiAl material | Ti42Al—5Mn | 1300 | 1300 | 2 | 20 | α2/ lamellar structure + β-phase + γ-phase | 80 (Only lamella grain) |
| Example 2 | Hot-forged TiAl material of present invention | Ti—41Al—0.6Cr—4Nb | 1350 | 1200 | 2 | 3 | α2/γ-perfect lamellar structure | 70 |

TABLE 1-continued

| Compare tensile properties to each other in materials of present invention and Comparative Examples | | | | | | |
|---|---|---|---|---|---|---|
| | Tensile property | | | | | |
| | Room temperature | | 850° C. | | 950° C. | |
| | Strength (MPa) | Elongation (%) | Strength (MPa) | Elongation (%) | Strength (MPa) | Elongation (%) |
| Comparative Example 9 | 465 | 0.2 | 472 | 1.3 | 353 | 3.2 |
| Comparative Example 10 | 540 | 0.7 | 340 | 10.5 | 146 | 30.5 |
| Example 2 | 650 | 1.5 | 527 | 4.2 | 327 | 14.5 |

Figure 18:
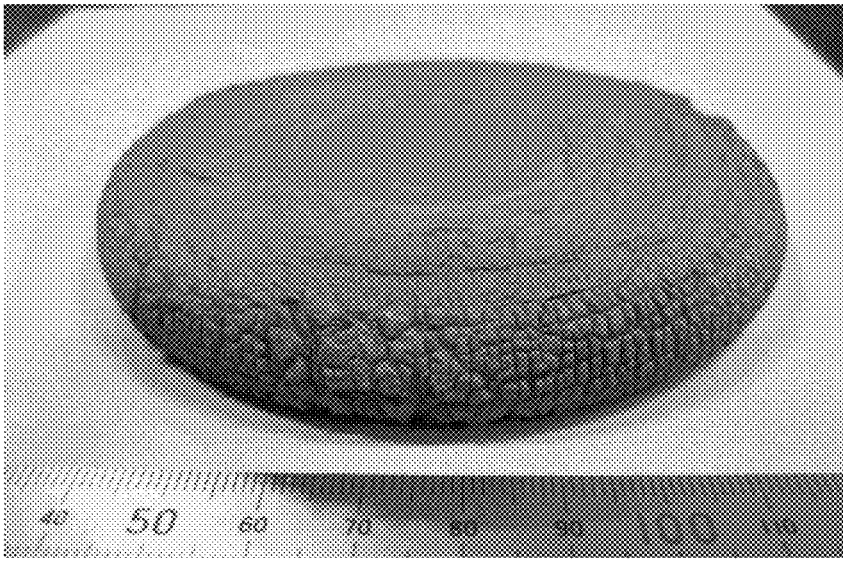
FIG. 18 is an appearance photograph of a hot-forged TiAl material according to a second embodiment of the present invention which is subjected to hot forging at 1350° C.

FIG. 18 is an appearance photograph when a hot-forged TiAl material (composition: Ti-41Al-0.6Cr-4Nb (at %)) of the second embodiment of the present invention is subjected to the hot forging at 1350° C. The forging temperature is within an (α+γ) region. Since the β-phase having excellent high temperature deformability exists, forgeability of this hot forged material is good, and no crack occurs.

Figure 19:
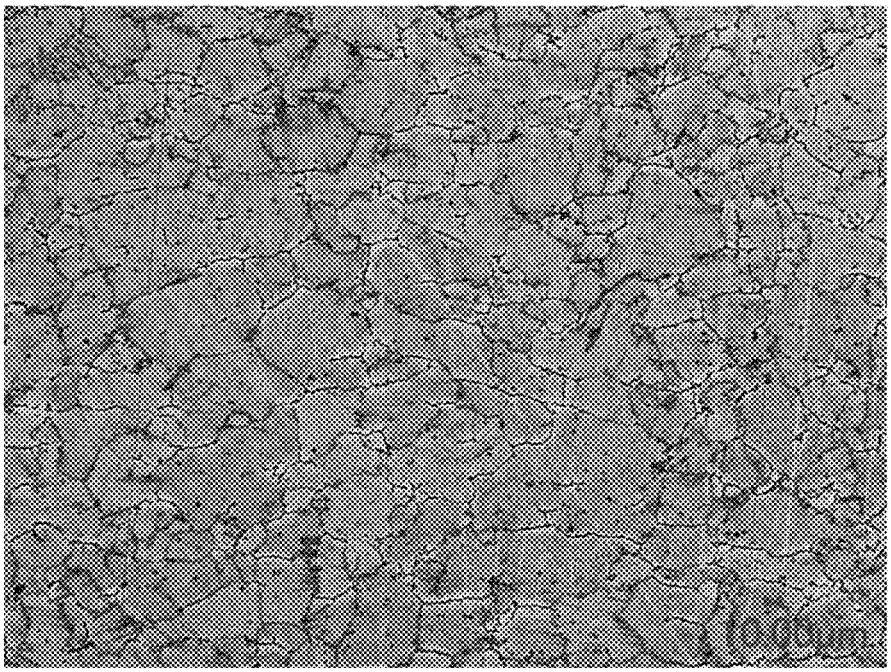
FIG. 19 is an optical microscope photograph for a structure of the forged material illustrated in FIG. 18.

FIG. 19 is a structure photograph of an optical microscope of the forged material illustrated in FIG. 18. A horizontal line of a right corner indicates 10 μm. By the effect of plastic strain due to the forging, the crystal grain size becomes fine, for example, about 10 to 100 μm.

FIGS. 20(A) and (B) are reflected electron image photographs of a test material obtained in such a manner that the hot-forged TiAl material (composition: Ti-41Al-0.6Cr-4Nb (at %)) according to the second embodiment of the present invention is held at 1200° C. of the α-region for two hours and is then cooled at 3° C./min. FIG. 20(A) is a low magnification photograph, and FIG. 20(B) is a high magnification photograph. The structure is a perfect lamellar structure consisting of α2-phase and γ-phase, and is similar to that of the casting material. In the heat-treated material, the β-phase having excellent high temperature deformability (low high-temperature strength) does not exist. The grain size is slightly coarsened compared to that of the forged alloy, but becomes significantly smaller than that of a casting material illustrated in FIG. 27. Therefore, since this hot forged material has the above structure, it is excellent in both of the high-temperature strength and the room-temperature ductility.

FIGS. 21(A) to (C) illustrate a hot forging test for evaluating hot forgeability of the TiAl alloy including the hot-forged TiAl material according to the second embodiment of the present invention; FIG. 21(A) illustrates an appearance photograph of the ingot and a cutting position (using a lower side) of a material subjected to a forging test, FIG. 21(B) is a circumstantial photograph during the hot forging test, and FIG. 21(C) is an explanatory view of a change of height in the hot forging test.

FIG. 21(A) is an appearance photograph of an ingot prepared by a composition indicated in Tables 2 and 3. The ingot is prepared by high-frequency melting using an yttria crucible. A raw material of the ingot includes sponge Ti, Al grains, and at least one of Cr, Mo, Mn, Nb, or V as an additive element. A melting atmosphere is in argon gas. The weight of the ingot in the photograph was about 700 g, but the weight of the ingot after riser cutting was about 450 g.

FIGS. 21(B) and 21(C) illustrate the circumstantial photograph during the hot forging test and the explanatory view. The heating temperature is 1350° C., the speed of press is 50 mm/second or faster, the forging direction is upset, and the number of times of the forging is seven times. The material is subjected to reheating every each forging. In the hot forging test, the height is changed into 90 mm, 80 mm, 70 mm, 55 mm, 40 mm, 30 mm, 20 mm, and 15 mm, and compression is performed in this order.

Tables 2 and 3 indicate a composition and a test result of an ingot in which the hot forgeability and the presence or absence of the β-phase residue after the heat treatment are investigated.

TABLE 2

| Composition and test result of ingot in which hot forgeability and presence or absence of β-phase residue after heat treatment are investigated (Part 1) | | | | | | | | | |
|---|---|---|---|---|---|---|---|---|---|
| Alloy composition (at %) | | | | | | | Cr equivalent | Test result | |
| Al | Cr | Mo | Mn | Nb | V | Ti | (Cr + Mo + 0.5Mn + 0.25Nb + 0.25V) | Forging test | Structure after heat treatment |
| 39 | | | 1.00 | | | Balance | 0.50 | Crack occurrence | Perfect lamellar structure |
| 39 | | 0.50 | 0.60 | | | Balance | 0.80 | Crack occurrence | Perfect lamellar structure |
| 39 | 1.00 | | | 2.00 | | Balance | 1.50 | Good | Residue of β-phase |
| 40 | | | 1.00 | 1.00 | | Balance | 0.75 | Crack occurrence | Perfect lamellar structure |

TABLE 2-continued

Composition and test result of ingot in which hot forgeability and presence or absence of β-phase residue after heat treatment are investigated (Part 1)

| Alloy composition (at %) | | | | | | | Cr equivalent (Cr + Mo + 0.5Mn + 0.25Nb + 0.25V) | Test result | |
|---|---|---|---|---|---|---|---|---|---|
| Al | Cr | Mo | Mn | Nb | V | Ti | | Forging test | Structure after heat treatment |
| 40 | | | 1.00 | | 2.00 | Balance | 1.00 | Crack occurrence | Perfect lamellar structure |
| 40 | 1.13 | | | | | Balance | 1.13 | Good | Perfect lamellar structure |
| 40 | 2.00 | | | | | Balance | 2.00 | Good | Residue of β-phase |
| 40 | 3.00 | | | | | Balance | 3.00 | Good | Residue of β-phase |
| 40.5 | 1.00 | | 0.40 | | | Balance | 1.20 | Good | Perfect lamellar structure |
| 40.5 | | | 3.20 | | | Balance | 1.60 | Good | Perfect lamellar structure |
| 40.5 | | | | 8.00 | | Balance | 2.00 | Good | Residue of β-phase |
| 40.5 | 1.00 | | | 5.00 | | Balance | 2.25 | Good | Residue of β-phase |
| 41 | 0.50 | | | 1.00 | | Balance | 0.75 | Crack occurrence | Perfect lamellar structure |
| 41 | 0.50 | | | 2.00 | | Balance | 1.00 | Crack occurrence | Perfect lamellar structure |
| 41 | | 2.50 | | | | Balance | 2.50 | Good | Residue of β-phase |
| 41 | 2.00 | 1.50 | | | | Balance | 3.50 | Good | Residue of β-phase |
| 41.5 | | 1.13 | | | | Balance | 1.13 | Good | Perfect lamellar structure |

TABLE 3

Composition and test result of ingot in which hot forgeability and presence or absence of β-phase residue after heat treatment are investigated (Part 2)

| Alloy composition (at %) | | | | | | | Cr equivalent (Cr + Mo + 0.5Mn + 0.25Nb + 0.25V) | Test result | |
|---|---|---|---|---|---|---|---|---|---|
| Al | Cr | Mo | Mn | Nb | V | Ti | | Forging test | Structure after heat treatment |
| 42 | 0.50 | | | | 1.00 | Balance | 0.75 | Crack occurrence | Perfect lamellar structure |
| 42 | 0.50 | | | 2.00 | | Balance | 1.00 | Crack occurrence | Perfect lamellar structure |
| 42 | | | 2.40 | | | Balance | 1.20 | Good | Perfect lamellar structure |
| 42 | | | 2.90 | | | Balance | 1.45 | Good | Perfect lamellar structure |
| 42 | | 1.00 | 1.20 | | | Balance | 1.60 | Good | Perfect lamellar structure |
| 42 | | | | | 8.00 | Balance | 2.00 | Good | Perfect lamellar structure |

TABLE 3-continued

Composition and test result of ingot in which hot forgeability and presence or absence of β-phase residue after heat treatment are investigated (Part 2)

| Alloy composition (at %) | | | | | | | Cr equivalent | Test result | |
|---|---|---|---|---|---|---|---|---|---|
| Al | Cr | Mo | Mn | Nb | V | Ti | (Cr + Mo + 0.5Mn + 0.25Nb + 0.25V) | Forging test | Structure after heat treatment |
| 42 | 1.00 | | | | 5.00 | Balance | 2.25 | Good | Residue of β-phase |
| 42 | | | | 5.00 | 5.00 | Balance | 2.50 | Good | Residue of β-phase |
| 43 | 0.50 | | | | 1.00 | Balance | 0.75 | Crack occurrence | Perfect lamellar structure |
| 43 | 0.50 | | | 2.00 | | Balance | 1.00 | Crack occurrence | Perfect lamellar structure |
| 43 | 0.40 | 0.80 | | | | Balance | 1.20 | Crack occurrence | Perfect lamellar structure |
| 42.8 | | | 1.00 | 4.00 | | Balance | 1.50 | Good | Perfect lamellar structure |
| 42.8 | | | 1.00 | 6.00 | | Balance | 2.00 | Good | Perfect lamellar structure |
| 42.8 | 2.00 | | | | 2.00 | Balance | 2.50 | Good | Residue of β-phase |
| 43.5 | | 2.00 | 1.00 | | | Balance | 2.50 | Crack occurrence | Residue of β-phase |
| 44 | 1.00 | | | | | Balance | 1.00 | Crack occurrence | Perfect lamellar structure |
| 44 | 1.00 | | 1.00 | | | Balance | 1.50 | Crack occurrence | Perfect lamellar structure |
| 44 | 1.00 | | | 4.00 | | Balance | 2.00 | Crack occurrence | Perfect lamellar structure |
| 44 | 2.00 | | | | 4.00 | Balance | 3.00 | Crack occurrence | Residue of β-phase |
| 45 | 1.00 | | 1.00 | | | Balance | 1.50 | Crack occurrence | Perfect lamellar structure |
| 45 | 1.00 | | | 4.00 | | Balance | 2.00 | Crack occurrence | Perfect lamellar structure |
| 45 | 0.50 | | 1.00 | 1.00 | 5.00 | Balance | 2.50 | Crack occurrence | Perfect lamellar structure |
| 45 | 2.00 | | | | 4.00 | Balance | 3.00 | Crack occurrence | |
| 46 | 1.00 | | 1.00 | | | Balance | 1.50 | Crack occurrence | Residue of β-phase |
| 46 | 1.00 | | | 4.00 | | Balance | 2.00 | Crack occurrence | Perfect lamellar structure |
| 46 | 2.00 | | | | 4.00 | Balance | 3.00 | Crack occurrence | Perfect lamellar structure |

Figure 22:
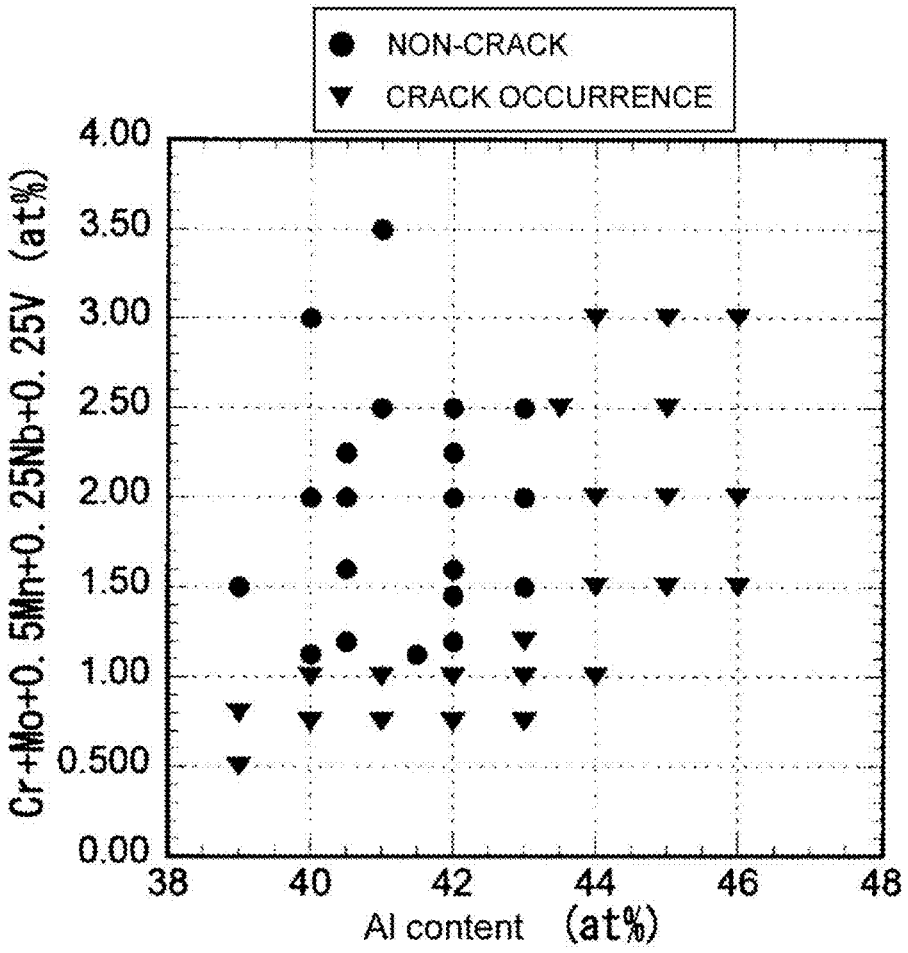
FIG. 22 is a diagram illustrating an influence of Al content and Cr equivalent on the hot forgeability of the TiAl alloy including the hot-forged TiAl material according to the second embodiment of the present invention, and illustrates a state of crack occurrence in the hot forging.

FIG. 22 is a diagram illustrating an influence of Al content and Cr equivalent on the hot forgeability of the TiAl alloy including the hot-forged TiAl material according to the second embodiment of the present invention, and illustrates a state of crack occurrence in the hot forging. Here, plots in FIG. 22 correspond to separate ingots, respectively. Additive elements have different effects, respectively, but the results can be better summarized in the case of using the formula of Cr+Mo+0.5Mn+0.25Nb+0.25V (at %). When the Cr equivalent was 1 at % or more and the Al content was 43 at % or less, it could be confirmed that the hot forging could be performed without cracks.

FIGS. 23(A) and 23(B) are examples of appearance photographs for the test material after the hot forging test of FIG. 22, respectively. FIG. 23(A) illustrates a case where no crack occurs, and FIG. 23(B) illustrates a case where the crack occurs.

Figure 24:
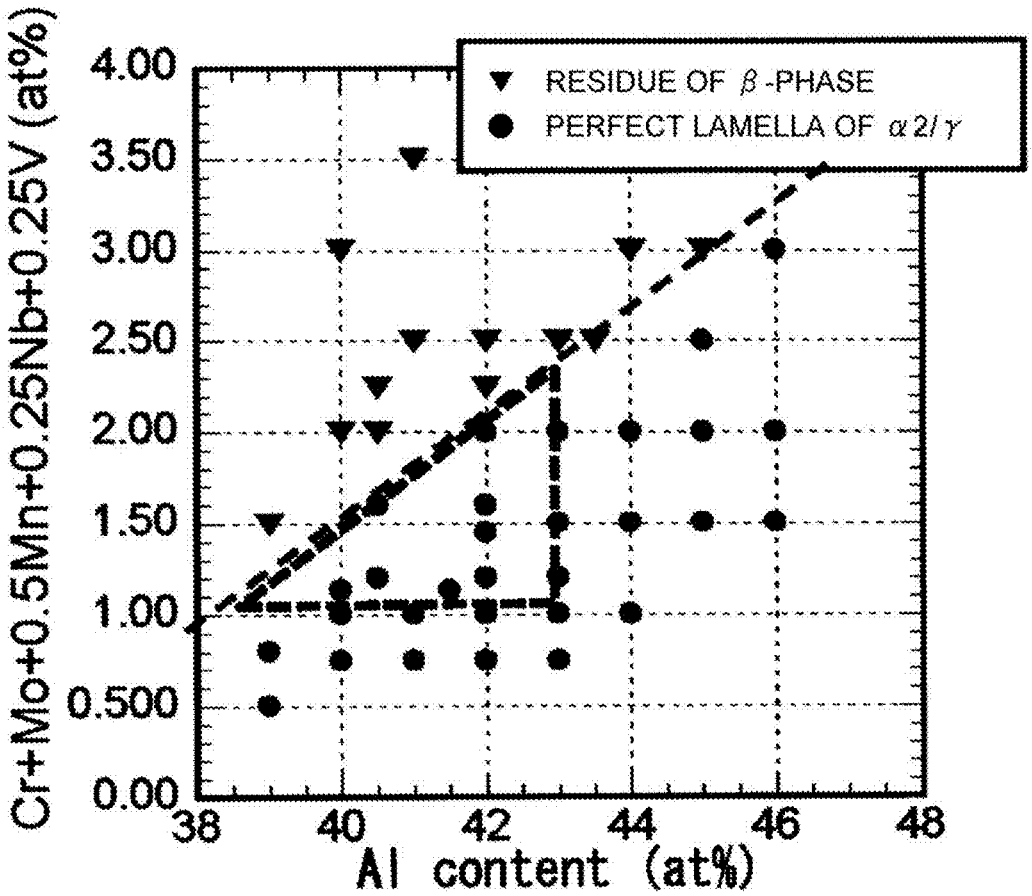
FIG. 24 is a diagram illustrating an influence of Al content and Cr equivalent on the change in structure of a forged material of the TiAl alloy including the hot-forged TiAl material according to the second embodiment of the present invention subjected to the heat treatment, and illustrates the presence or absence of a β-phase residue.

FIG. 24 is a diagram illustrating an influence of Al content and Cr equivalent on the change in structure of a forged material of the TiAl alloy including the hot-forged TiAl material according to the second embodiment of the present invention subjected to the heat treatment, and illustrates the presence or absence of the β-phase residue. Here, the test is performed using the hot-forged material of the ingot prepared by the composition of Tables 2 and 3. With respect to test conditions, a small piece cut from the hot-forged material is subjected to a heat treatment in such a manner that the small piece is cooled at 0.2° C./min. after being held at 1350° C. for two hours. In the heat treatment test conditions relating to this drawing, the piece was cooled at a very slow rate so as to investigate whether the β-phase finally remained in each composition. Accordingly, the crystal grain size becomes coarse.

Additive elements have different effects, respectively, but the results can be better summarized in the case of using the Cr equivalent of the formula of Cr+Mo+0.5Mn+0.25Nb+0.25V (at %). In FIG. 24, the β-phase remains in the composition located above a slanted dotted line, and the β-phase is eliminated in the composition located below the slanted dotted line during the cooling and thus a perfect lamellar structure of α2/γ is formed. In the drawing, the perfect lamellar structure of α2/γ is formed in the range surrounded by a dotted line and the composition in this range exhibits the excellent hot forgeability illustrated in FIG. 22.

FIGS. 25(A) and (B) are examples of reflected electron image photographs of the forged material of the TiAl alloy in FIG. 24 which is subjected to the heat treatment; FIG. 25(A) illustrates an example of a structure in which the β-phase remains, and FIG. 25(B) illustrates an example of a structure in which a perfect lamellar structure is obtained without the remaining of the β-phase.

The following drawings relate to a TiAl-casting material as Comparative Example and a conventional hot-forged TiAl material.

Comparative Example 9

Figure 26:
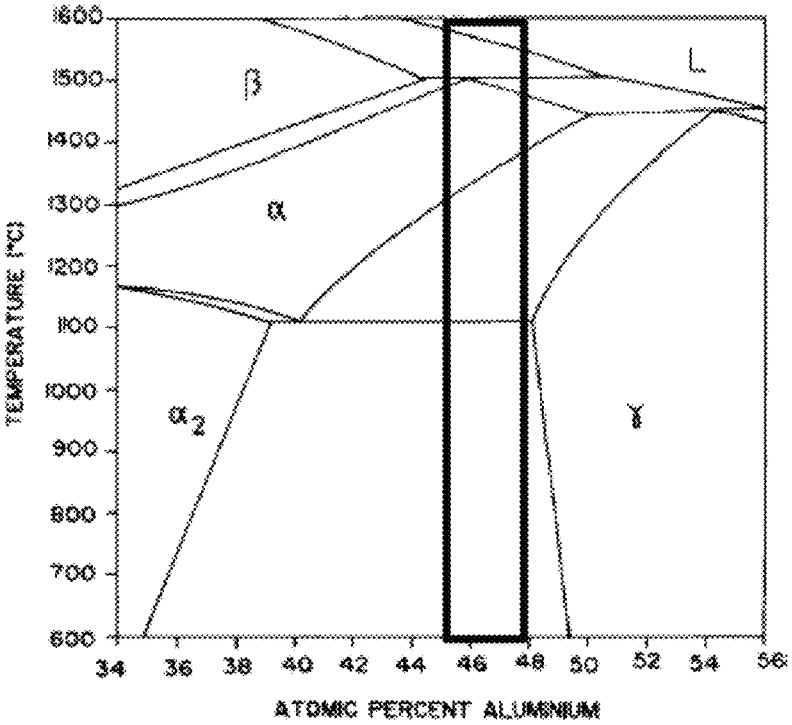
FIG. 26 is an explanatory view of a typical composition range in a TiAl-binary phase diagram of a TiAl-casting material as Comparative Example.

FIG. 26 is an explanatory view of a typical composition range in a TiAl-binary phase diagram of the TiAl-casting material. Since the amount of β-phase stabilization element (Mn, Cr, Mo, V, or the like) to be added to the casting material is small, even if added, the phase state is not changed from FIG. 26. The phase transformation of a α→α+γ→α2+γ occurs, and the β-phase is not stable even in the high temperature.

Figure 27:
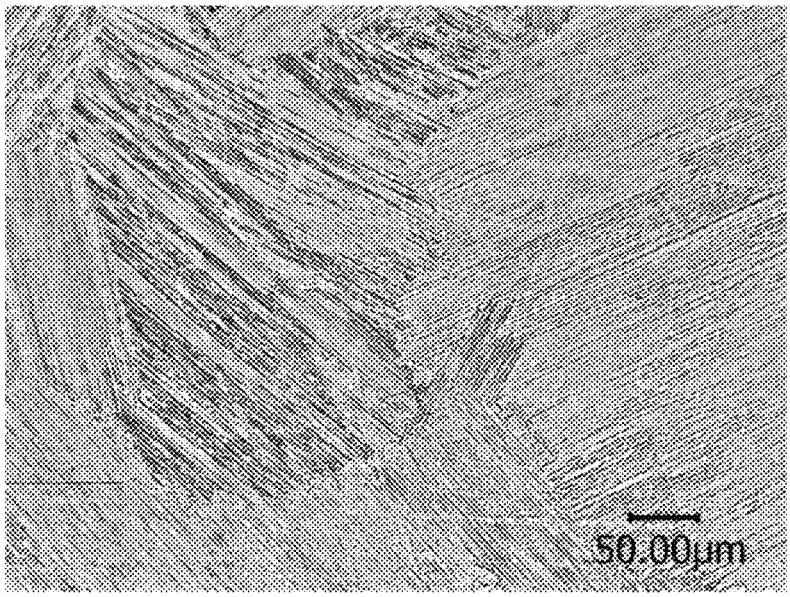
FIG. 27 is a photograph of an optical microscope structure for the TiAl-casting material as Comparative Example.

FIG. 27 is a photograph of an optical microscope structure for the conventionally compositional TiAl-casting material (composition of Ti-46 at % Al). The crystal grain size is coarse and thus the room-temperature ductility is poor.

Figure 28:
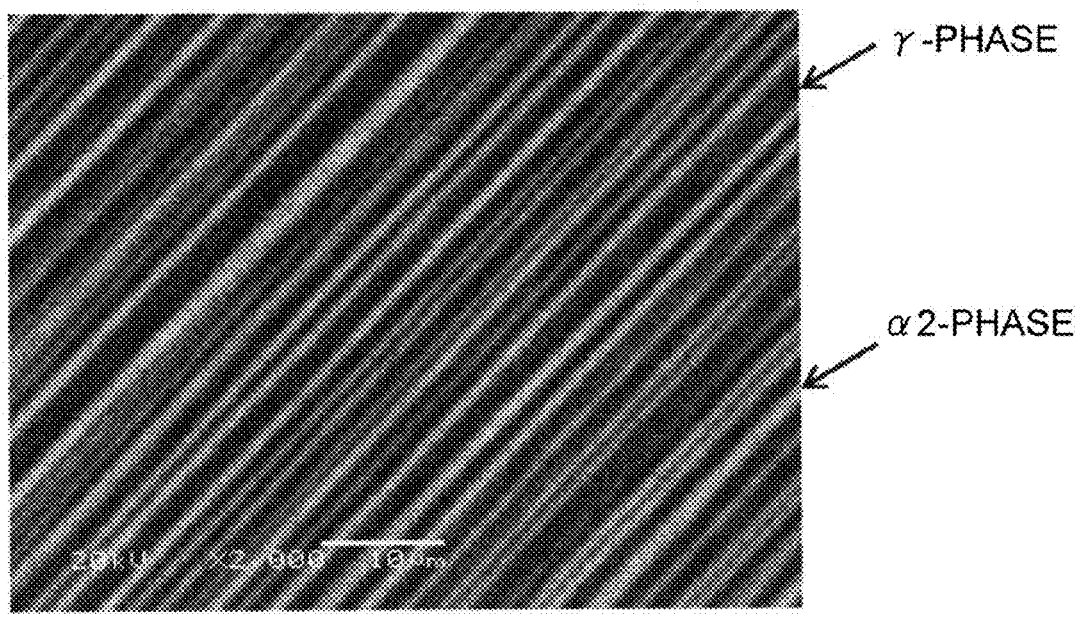
FIG. 28 is a photograph of a reflected electron image structure for the TiAl-casting material as Comparative Example.

FIG. 28 is a photograph of a reflected electron image structure for the conventionally compositional TiAl-casting material (composition of Ti-46 at % Al). The TiAl-casting material consists of γ-phase and α2-phase and has a lamellar structure layered with the above two phases. Here, since all structures is made up of this lamellar structure, a perfect lamellar structure is obtained. The TiAl-casting material has the perfect lamellar structure and is high in terms of high-temperature strength, which can be used up to about 850° C.

Figure 29:
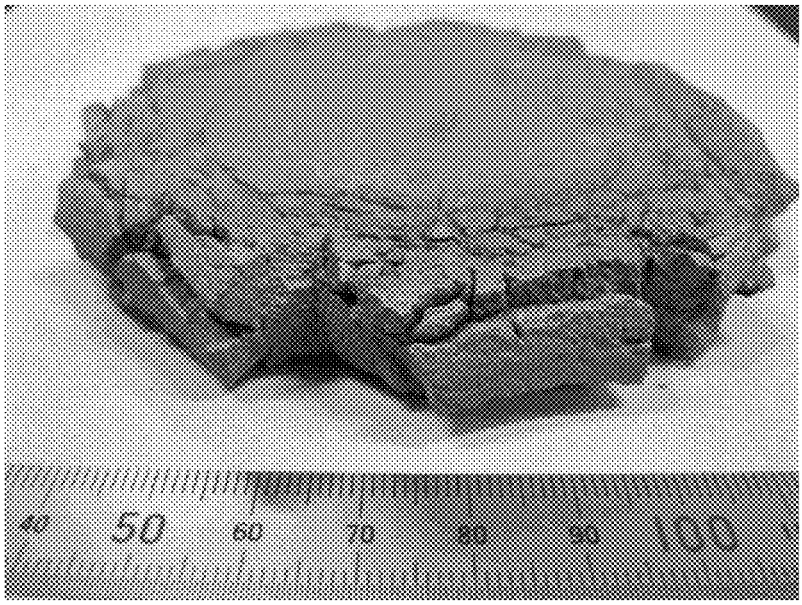
FIG. 29 is an appearance photograph of the TiAl-casting material as Comparative Example in the case of being subjected to the hot forging at 1350° C.

FIG. 29 is an appearance photograph of the conventionally compositional TiAl-casting material (composition of Ti-46 at % Al) in the case of being subjected to the hot forging at 1350° C. Since the β-phase (phase in which the high temperature deformability is excellent) does not exist, deformability is poor and a large crack has occurred.

Comparative Example 10

Figure 30:
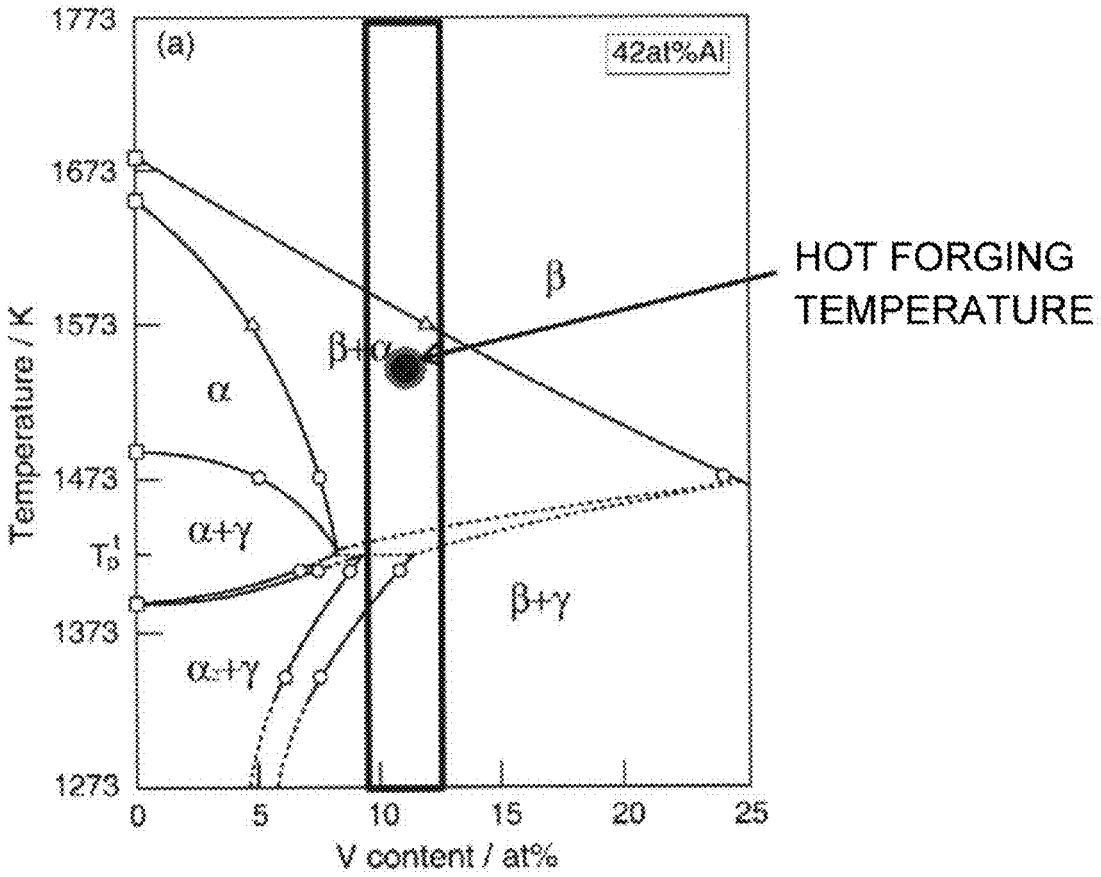
FIG. 30 is an explanatory view of a typical composition range in a phase diagram of the conventional hot-forged TiAl material as Comparative Example.

FIG. 30 is an explanatory view of a typical composition range in a phase diagram of the conventionally compositional hot-forged TiAl alloy. The phase diagram is a phase diagram of TiAl-V ternary alloy in which Al content is fixed to 42 at % and the β-phase is stabilized by the addition of the β-stabilization element (V in this case). Basic components are common even when the addition element is Mn, Cr, Mo, or Nb, but the location of each phase varies depending on the addition element. In addition, the location of each phase also varies depending on the variation of the Al content. Here, a region surrounded by a rectangular solid line indicates the composition of the conventional hot-forged TiAl alloy in a case where the addition element is V. However, since the V content is in the range of 9 to 13 at %, a (β+α)-phase region appears near 1300° C., and the β-phase is stable even in a low-temperature side lower than 1000° C. Thus, the β-phase remains in the final product even when any heat treatment is performed. In addition, in the case of using at a high temperature for a long time as a product, it becomes close to an equilibrium state, and the amount of β-phase may increase.

Figure 31:
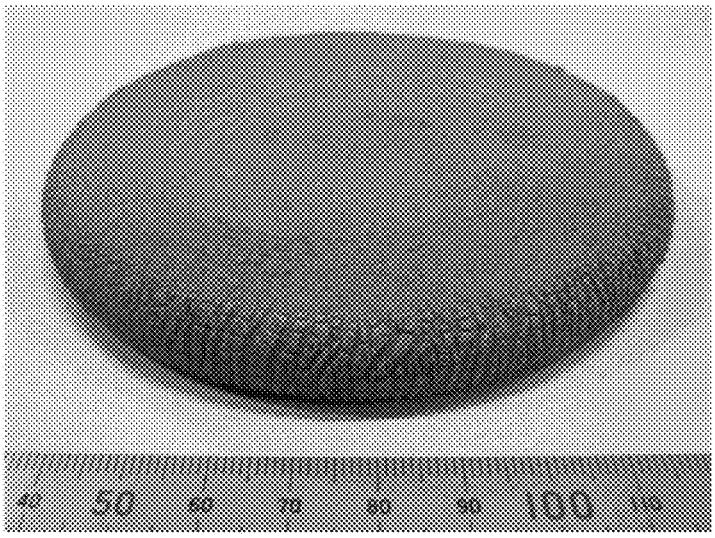
FIG. 31 is an appearance photograph of an ingot for the conventional hot-forged TiAl material, as Comparative Example, which is subjected to the hot forging at 1300° C.

FIG. 31 is an appearance photograph of the conventionally compositional hot-forged TiAl material (composition of Ti-42Al-5Mn (at %)) which is subjected to the hot forging at 1300° C. A forging temperature is a (α+β) region. Since the β-phase having excellent high temperature deformability exists, forgeability is good and no crack occur.

Figure 32:
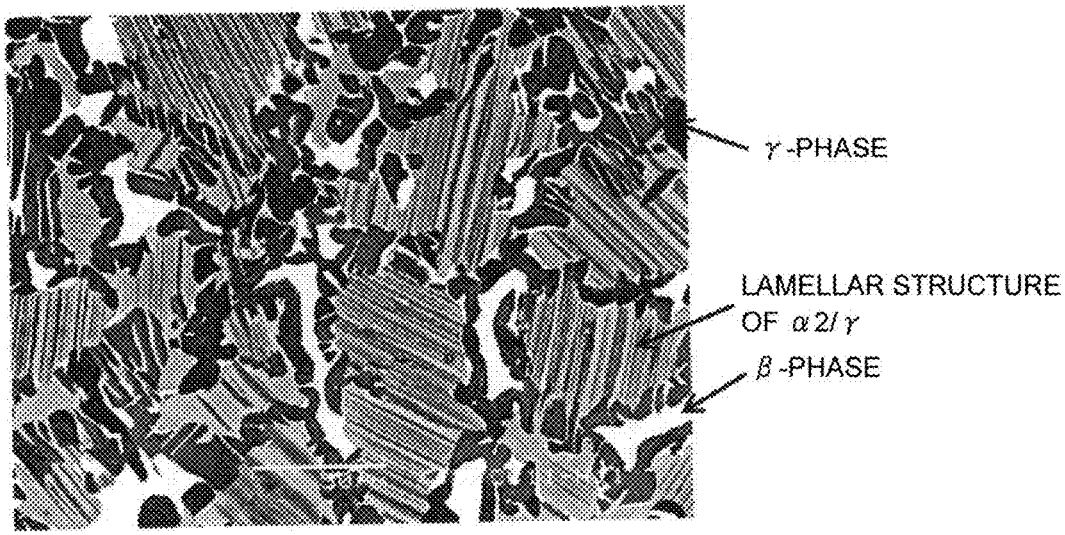
FIG. 32 is a reflected electron image of a test material obtained in such a manner that the conventional hot-forged TiAl material as Comparative Example is subjected to cooling treatment at 20° C./min. after being held at 1300° C. for two hours.

FIG. 32 is a reflected electron image of a test material obtained in such a manner that the conventionally compositional hot-forged TiAl material (composition of Ti-42Al-5Mn (at %)) is subjected to cooling treatment at 20° C./min. after being held at 1300° C. for two hours. The structure of this hot forged material includes a β-phase, a γ-phase, and a lamellar structure of α2/γ. Since the β-phase having excellent high temperature deformability (low high-temperature strength) exists, the high-temperature strength is low, and an available temperature is about 700° C. Then, it is not possible to eliminate the β-phase by the change of heat treatment conditions. The reason is that the β-phase is stable in a low temperature with this composition.

The above embodiments are merely made to describe in detail the present invention. Accordingly, the present invention should not be restrictively construed with the above embodiments. The TiAl-based alloy of the present invention or the method for producing the TiAl-based alloy includes ratio changes of composition elements within an obvious range in a person skilled in the art, for example, composition changes in an allowable range included inevitably in manufacturing or composition changes in an allowable range depending on variations in purchase price or fluctuations in supply state of raw-material compositions.

INDUSTRIAL APPLICABILITY

The TiAl-based alloy according to the present invention is excellent in high-temperature strength or impact resistance, and thus is suitably used for a rotor blade of a gas turbine or steam turbine for power generation, aircraft, ship, or various industrial machines.

The TiAl-based alloy material produced by the present invention is excellent in high-temperature strength and has excellent ductility or impact properties. When this material is used for the rotor blade of various turbines or turbocharger, it is possible to improve energy efficiency due to an increase in an engine speed and contribute to reduction in weight while maintaining reliability.

In addition, the TiAl-based alloy according to the present invention can be used to manufacture large parts from excellent hot forgeability and is suitably used for the rotor blade or a disk of an aircraft engine or the gas turbine for power generation because of being excellent in high-temperature strength, room-temperature ductility, or the like.

In the case of using the TiAl-based alloy according to the present invention, it is possible to obtain a large-scaled material which is excellent in high-temperature strength and room-temperature ductility. Since the rotor blade or disk made of this material has excellent high-temperature strength or room-temperature ductility, when this material is used for the rotor blade of the aircraft engine or the gas turbine for power generation, it is possible to improve energy efficiency due to an increase in an engine speed and an increase in size of parts while maintaining reliability.

The invention claimed is:

1. A TiAl-based alloy, consisting of:

Al: 41 to 45 atom %,

Nb: 7 to 9 atom %,

Cr: 0.4 to 4.0 atom %,

Si: 0.3 to 1.0 atom %,

C: 0.3 to 1.0 atom %, optionally 0.1 to 3 atom % total of at least one element selected from the group consisting of W, Mo, B, Hf, Ta, and Zr, and a balance of Ti and inevitable impurities, wherein an alloy element parameter P obtained by the following formula is in the composition range of from 1.1 to 2.3;

$$P=(41-Al)/3+0.25Nb+0.8Cr-0.8Si-1.7C, \text{ and}$$

the TiAl-based alloy has a fine structure in which lamella grains laminated alternately with a $Ti_3Al$ phase ($\alpha 2$-phase) and a TiAl phase ($\gamma$-phase) are densely arranged and a $\beta$-phase is not included, the lamella grains having an average grain size of 1 to 200 μm.

2. A rotor blade for turbine that uses the TiAl-based alloy material produced in such a manner that an ingot having the composition according to claim 1 is produced by a production method comprising:

a process in which the TiAl-based alloy according to claim 1 is held at a coexisting temperature range of a hexagonal close-packed structure phase ($\alpha$-phase) and a body-centered cubic structure phase ($\beta$-phase) and is then subjected to hot forging; and a process in which the hot-forged TiAl-based alloy material is held in a temperature range of from 1230° C. to 1290° C. for 1 to 20 hours and is subjected to a heat treatment at a cooling rate of from 1 [° C./min.] to 10 [° C./min.] at the same time.

3. A turbine that uses the rotor blade for turbine according to claim 2.

* * * * *